US006581529B1

(12) United States Patent
Maejima

(10) Patent No.: US 6,581,529 B1
(45) Date of Patent: Jun. 24, 2003

(54) INCINERATOR WITH CERAMICS FILTER

(75) Inventor: Takashi Maejima, 3236, Asahidai 3-chome, Ishioka city, Ibaraki 315-0038 (JP)

(73) Assignee: Takashi Maejima, Ibaraki (JP)

( * ) Notice: Subject to any disclaimer, the term of this patent is extended or adjusted under 35 U.S.C. 154(b) by 0 days.

(21) Appl. No.: 09/869,298

(22) PCT Filed: Sep. 1, 2000

(86) PCT No.: PCT/JP00/05953

§ 371 (c)(1),
(2), (4) Date: Oct. 23, 2001

(87) PCT Pub. No.: WO01/38785

PCT Pub. Date: May 31, 2001

(30) Foreign Application Priority Data

Nov. 22, 1999 (JP) ..... 11/331883

(51) Int. Cl.[7] ..... F23B 1/12; F23J 15/00

(52) U.S. Cl. ..... 110/216; 110/346; 110/295; 110/217; 110/345; 110/235

(58) Field of Search ..... 110/295, 216, 110/217, 345, 346, 235

(56) References Cited

U.S. PATENT DOCUMENTS 2,845,882 A * 8/1958 Bratton ..... 110/8
3,566,809 A * 3/1971 Carry ..... 110/8
3,808,619 A * 5/1974 Vanderveer ..... 110/8 C
4,258,017 A * 3/1981 Gelfand ..... 423/210
4,508,040 A * 4/1985 Santen et al. ..... 110/347
4,599,952 A * 7/1986 Meier ..... 110/216
5,213,051 A * 5/1993 Kaneko ..... 110/229
5,913,273 A * 6/1999 Maejima ..... 110/248
6,324,999 B1 * 12/2001 Maejima ..... 110/225

* cited by examiner

*Primary Examiner*—Ira S. Lazarus
*Assistant Examiner*—K. B Rinehart
(74) *Attorney, Agent, or Firm*—Armstrong, Westerman & Hattori, LLP

(57) ABSTRACT

The present invention relates to an incinerator with a ceramics filter for incinerating raw refuse, general garbage, expanded polystyrene and others generated from a manufacturing plant, a wholesale market, a general firm, a general retail store, a general house and others.

According to the present invention, air intakes having a check valve provided thereto are formed to right and left lower portions of an incinerator; an oast is set in a combustion chamber; a tabular ceramics filter for removing a harmful substance is attached to the upper portion of the oast; and a suction port is formed to the upper portion of the tabular ceramics filter.

22 Claims, 40 Drawing Sheets ceramics filter ceramics filter spherical ceramics filter

INCINERATOR WITH CERAMICS FILTER

BACKGROUND OF THE INVENTION

1. Field of the Invention

The present invention relates to improvement of an incinerator for burning up an object to be incinerated such as raw garbage, general refuse, expanded polystyrene and others generated from a manufacturing plant, a wholesale market, a general firm, a general retail shop, a general house and others.

2. Description of the Prior Art

Conventionally, an object to be incinerated such as raw garbage, general refuse and others generated from a manufacturing plant, a wholesale market, a general firm, a general retail shop, a general house and others is burned up in an incinerator as it is. That is, as shown in FIG. 40, in case of burning up an object to be incinerated 78*g* in an incinerator 78, the object to be incinerated 78*g* is burned by a method for forcibly sending an air stream by a blast fan or blower 78*f* installed in the vicinity of an air intake 78*h*.

In other words, as shown in FIG. 40, since the object to be incinerated 78*g* set in the incinerator 78 is burned up by the system for forcibly sending an air stream to burn and incinerate the object to be incinerated 78*g* such as the incinerator 78, air is forcibly sent from the air intake 78*h* toward the object to be incinerated 78*g* for combustion by using a blast fan or blower 78*f*.

In the method for forcibly sending the air to burn up the object to be incinerated 78*g* in this manner, a part of the forcibly sent air collides with a surface 78*i* of the object to be incinerated 78*g*. The air which has collided with the surface 78*i* of the object to be incinerated 78*g* is returned in a direction of the air intake 78*h* as indicated by an arrow and convected in the vicinity of the blast fan or blower 78*f*, which results in a position where strong pressure air 78*e* is generated between the object to be incinerated 78*g* and the blast fan or blower 78*f*. The part of the air forcibly sent from the blast fan or blower 78*f* into the incinerator 78 passes through the both side surfaces of the object to be incinerated 3 to be emitted from an outlet 78*a* in the air.

As described above, since a pore 78*d* formed to the object to be incinerated 78*g* is minute, the loss of the air forcibly sent by the blast fan or blower 78*f* is high due to a pressure by air blasting, and the air hence collides with only the surface 78*i* of the object to be incinerated 78*g*. Therefore, the air does not enter the inside of the object to be incinerated 78*g*, and the inside of the object to be incinerated 78*g* is not completely burned up.

Further, a rear surface and rear portion 78*c* of the object to be incinerated 78*g* which is the part of the object to be incinerated 78*g* opposed to the outlet 78*a* become anaerobic. At the outlet 78*a*, only the weak pressure air 78*b* is obtained. Therefore, although only the outside of the object to be incinerated 78*g* is burned up, the inside of the object to be incinerated 3 is not completely incinerated.

However, since a general incinerator has a low combustion temperature, combustion smoke and exhaust gas containing harmful substances such as dioxin and the like is emitted. Additionally, since incinerated ash and the like discharged by burning the object to be incinerated includes harmful substances, the incinerated ash subjected to combustion can not be disadvantageously reused.

In case of burning up the objected to be incinerated by the incinerator, general garbage, raw refuse, paper, as well as a carrier bag in a convenience shop, general garbage made of plastic which generates toxic gases, and a plastic bottle or expanded polystyrene which is said to be a factor for generating dioxin are often collectively put in the incinerator to be incinerated without being separated. In particular, a large amount of water contained in them may lower a combustion temperature, and dioxin and the like is apt to be generated.

It is, therefore, an object of the present invention is to provide an incinerator having a filter made of ceramics (which will be referred to as a ceramics filter hereunder) attached thereto (which will be referred to as an incinerator with a ceramics filter hereinafter) which does not emit dioxin as a harmful substance even if waste such as raw refuse, general garbage, expanded polystyrene and the like produced from houses or firms is incinerated.

SUMMARY OF THE INVENTION

In order to achieve this aim, the present invention provides: an incinerator with a ceramics filter, wherein air intakes to which a check valve is provided are formed on right and left lower portions of the incinerator and an oast is set in a combustion chamber, a tabular ceramics filter for removing harmful substances being attached to an upper portion of the oast, a suction port being form to an upper portion of the tabular ceramics filter; an incinerator with a ceramics filter, wherein an air intake to which a check valve is provided is formed to a lower portion of the incinerator and an ashpan is accessibly set, an oast being set in a combustion chamber, a tabular ceramics filter for removing harmful substances being attached to an upper portion of the oast, a suction port being form to an upper portion of the tabular ceramics filter; an incinerator with a ceramics filter, wherein an ashpan is accessibly set to a lower portion of a combustion portion and an oast is set in a combustion chamber, a tabular ceramics filter for removing harmful substances being attached to an upper portion of the oast, a cyclone which inserts an end of an air duct of a blower to a lower edge of an exhaust duct attached to the cyclone and has a dust receiver being attached to the incinerator having a suction port formed thereto above the tabular ceramics filter; an incinerator with a ceramics filter, wherein an intake pipe bent under a combustion portion is connected to an ash receiving chamber in which an ashpan is accessibly set and a oast is set in a combustion chamber, a tabular ceramics filter for removing harmful substances being attached to an upper portion of the oast, a suction portion consisting of a cover and a cyclone which inserts an end of an air duct of a blower to a lower end of an exhaust duct attached to the cyclone and has a dust receiver being attached to the incinerator having a suction port above the tabular ceramics filter; an incinerator with a ceramics filter, wherein an intake pipe bent under a combustion portion is connected to an ash receiving chamber in which an ashpan is accessibly set and an oast is set in a combustion chamber, a tabular ceramics filter for removing harmful substances being attached to an upper portion of the oast, a first filter and a second filter which contain a storage box, are supported by a spring, has a vibrator attached thereto and accommodate therein a spherical ceramics filter being connected to the incinerator having a suction portion formed thereto above the tabular ceramics filter, an suction portion consisting of a cover and a cyclone which inserts an end of an air duct of a blower to a lower end of an exhaust duct attached to the cyclone and has a dust receiver being attached to the second filter; an incinerator with ceramics filter, wherein an intake pipe bent under a combustion portion is connected to an ash receiving chamber in which an ashpan is accessibly set and an oast is set in a combustion chamber, a tabular ceramics filter for removing harmful substances being attached above the oast, a first filter in which the tabular ceramics filter is vertically set in an installation container being connected to the incinerator having a suction port formed thereto above the tabular ceramics filter, a second filter which has a storage box, is supported by a spring, has a vibrator attached thereto and accommodates a spherical ceramics filter being connected to the first filter, a third filter which has a storage box, is supported by a spring, has a vibrator attached thereto and accommodates a spherical ceramics filter being connected to the second filter, a suction portion consisting of a cover and a cyclone which inserts an end of an air duct of a blower to a lower end of an exhaust tube attached to the cyclone and has a dust receiver being connected to the third filter; and a multistage incinerator with a ceramics filter, wherein a tabular ceramics filter is inclined and provided in a combustion chamber in multistage, a cabinet being provided to one end of the tabular ceramics filter inclined and provided in multistage, a burner being attached under the tabular ceramics filter.

DETAILED DESCRIPTION OF THE PREFERRED EMBODIMENTS

An incinerator with a ceramics filter according to the invention of the present application will now be described in detail with reference to the accompanying drawings.

Figure 1:
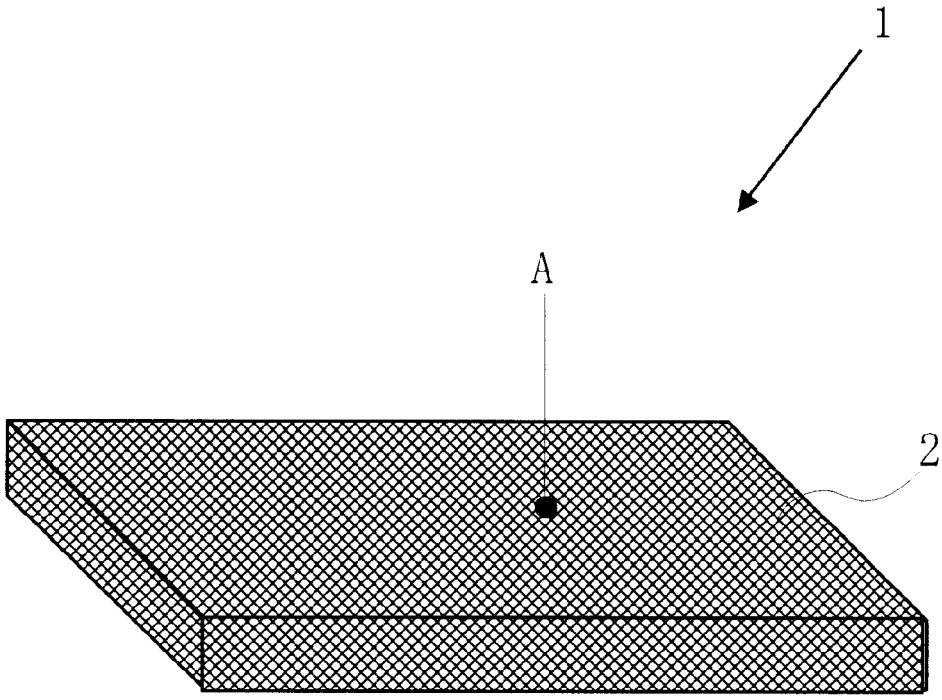
FIG. 1 is a perspective view showing a ceramics filter of an incinerator with a ceramics filter according to the present invention.
Figure 2:
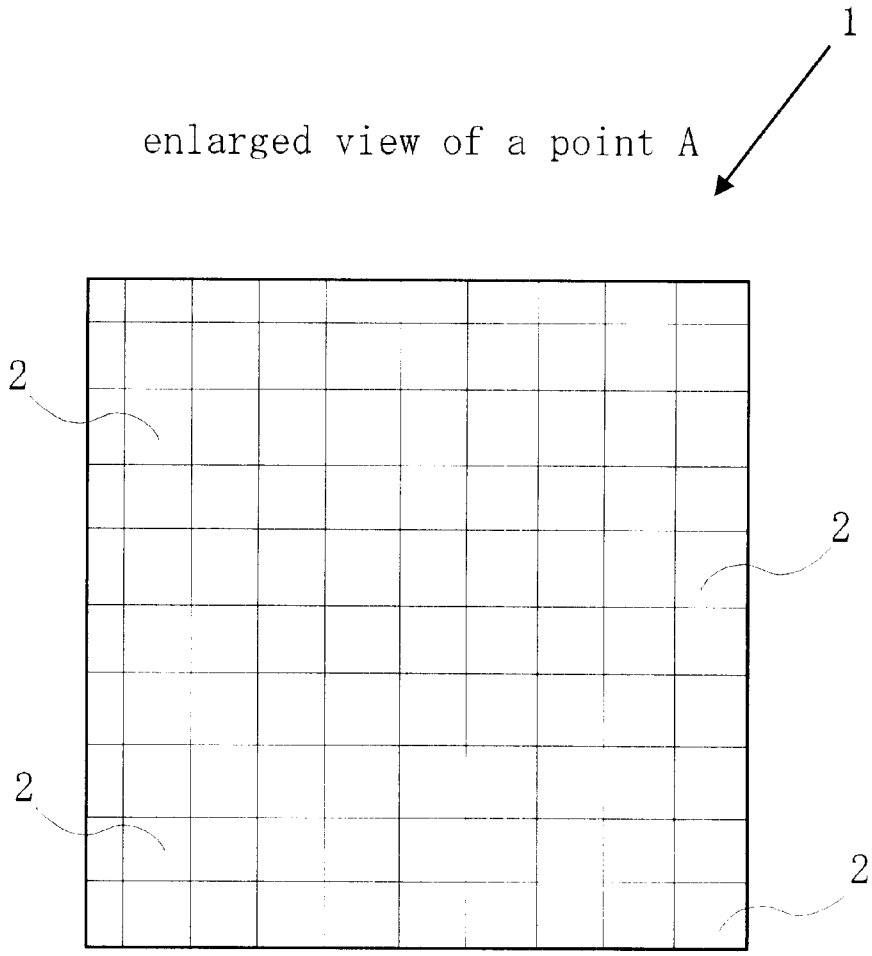
FIG. 2 is an enlarged plan view showing a point A of the ceramics filter of the incinerator with a ceramics filter according to the present invention.

FIG. 1 is a perspective view of a tabular ceramics filter used being attached to an incinerator with a ceramics filter according to the present invention, and FIG. 2 is an enlarged view of a point A in the tabular ceramics filter illustrated in FIG. 1. As shown in FIG. 1, a plurality of very minute pores 2 are formed to the tabular ceramics filter 1 as shown in FIG. 2. The minute pores 2 are smaller than molecules of dioxin as a harmful substance which is said to be generated when burning up an object to be incinerated.

The fine pores 2 are formed across the filter and the pore 2 is as small as a molecule. Molecules can be screened in a fixed range in accordance with a size of that pore. As a material of the ceramics filter, there are zeolite, silicalite activated carbon, porous glass and others, and zeolite is used as ceramics for the ceramics filter in the incinerator with a ceramics filter according to the present invention. Zeolite has uniform pores 2 whose size falls within a range of 0.3 to 1 nm. Since the size of a molecule of dioxin is approximately 1 nm, dioxin can be screened by zeolite. Only zeolite is taken as an example of a material of the ceramics filter used in the invention of the present application, ceramics of silicalite, activated carbon, porous glass and others may be used.

Figure 3:
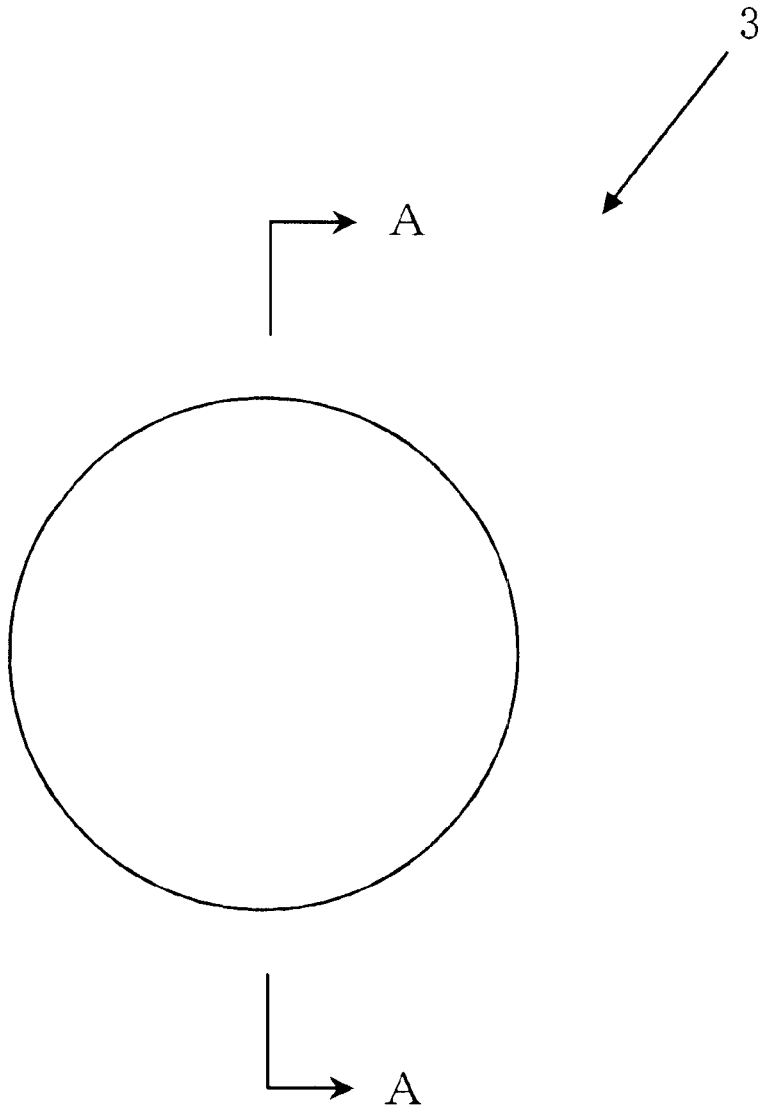
FIG. 3 is a front view showing a spherical ceramics filter of the incinerator with a ceramics filter according to the present invention.
Figure 4:
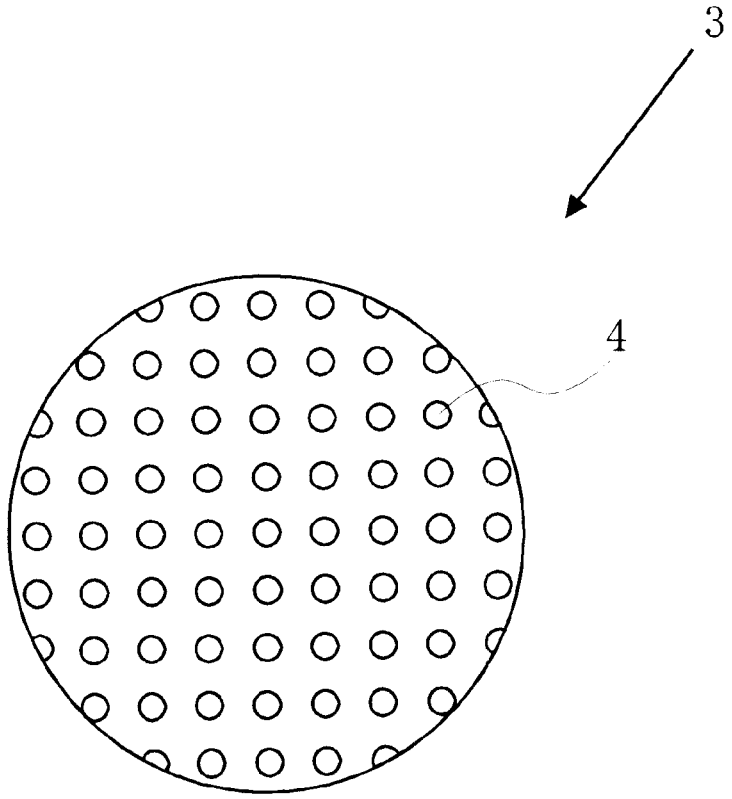
FIG. 4 is a cross-sectional view taken along the A—A line in FIG. 1, showing a spherical ceramics filter used in the incinerator with a ceramics filter according to the present invention.
Figure 5:
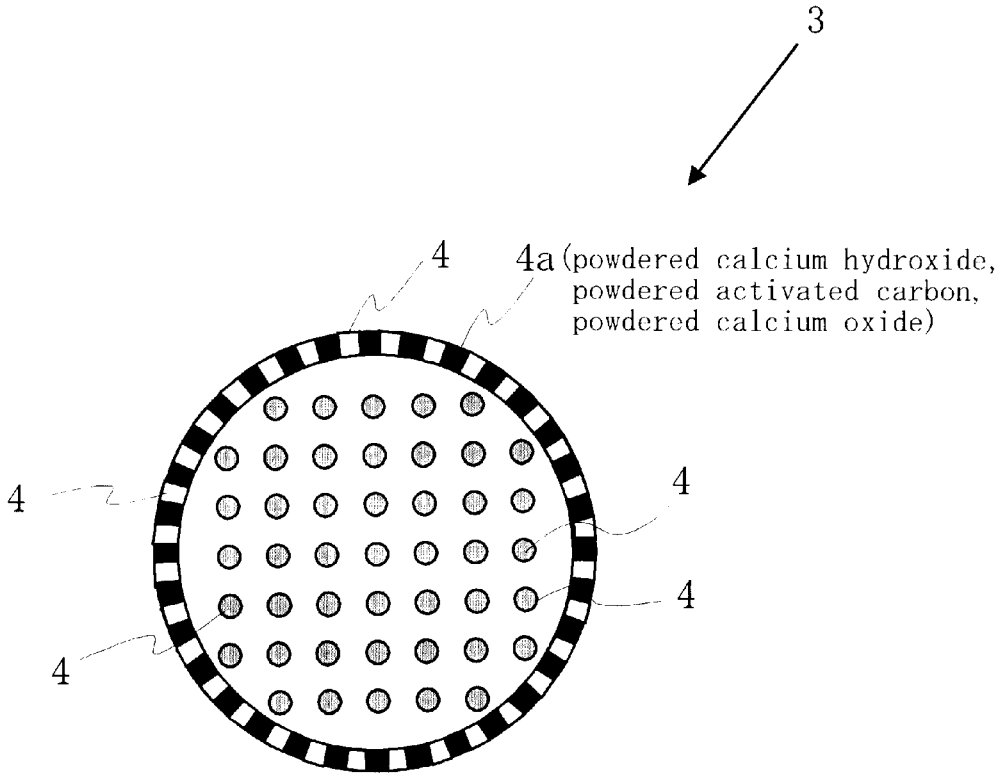
FIG. 5 is a cross-sectional view showing another embodiment of the spherical ceramics filter used in the incinerator with a ceramics filter according to the present invention.

FIG. 3 is a front view of a ceramics filter which is used in the incinerator with a ceramics filter according to the invention of the present application and in which ceramics used for removing dioxin as a harmful substance is spherically formed (which will be referred to as a spherical ceramics filter hereinafter); FIG. 4 is a longitudinal cross-sectional view taken along the A—A line in FIG. 3; and FIG. 5 is a longitudinal cross-sectional view showing that powdered calcium hydroxide, powdered activated carbon, powdered calcium oxide and the like is filled in the pores 4 of the spherical ceramics filter illustrated in FIG. 4.

As shown in FIG. 4, an infinite number of pores 4 are formed inside the spherical ceramics filter 3 depicted in FIG. 3. As shown in FIG. 5, powdered calcium hydroxide, powdered activated carbon and powdered calcium oxide 4*a* are filled in the pores 4 formed beyond number. With the spherical ceramics filter 3 having such a structure, harmful substances such as dioxin can be efficiently removed when this filter is used in the incinerator.

Figure 6:
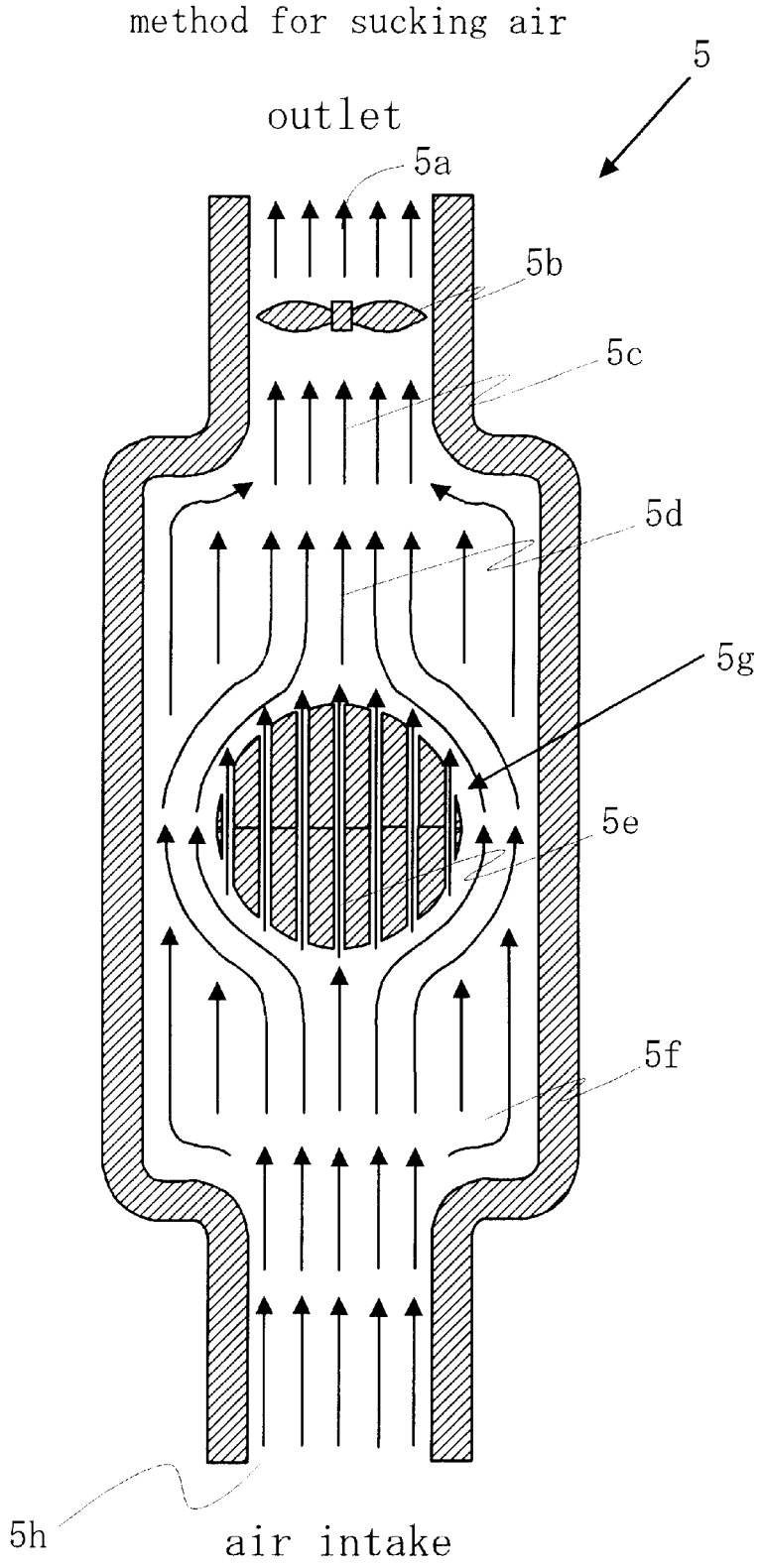
FIG. 6 is a typical drawing showing a flow of an air stream in case of a negative pressure suction method of the incinerator with a ceramics filter according to the present invention.
Figure 7:
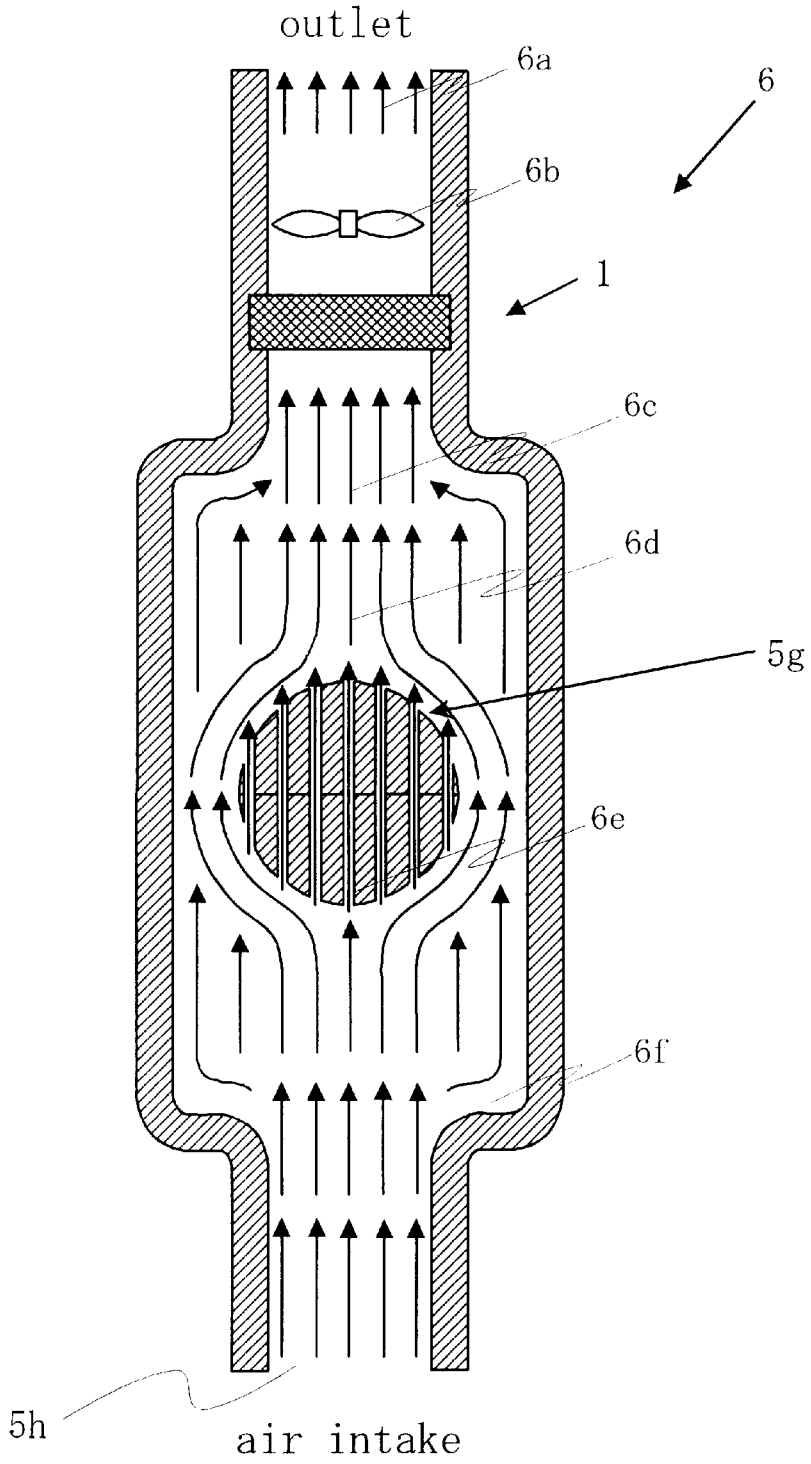
FIG. 7 is a cross-sectional view showing a flow of an air stream in cases where a ceramics filter is attached in a combustion furnace adopting the negative pressure suction method of the incinerator with a ceramics filter according to the present invention.

FIG. 6 is a longitudinal cross-sectional view of an incinerator for burning and incinerating an object to be incinerated by a method for sucking air, and FIG. 7 is a longitudinal cross-sectional view showing the state where the tabular ceramics filter is attached at a position close to a suction fun disposed in the vicinity of an outlet of the incinerator for burning and incinerating the object to be incinerated by the method for sucking air.

Figure 40:
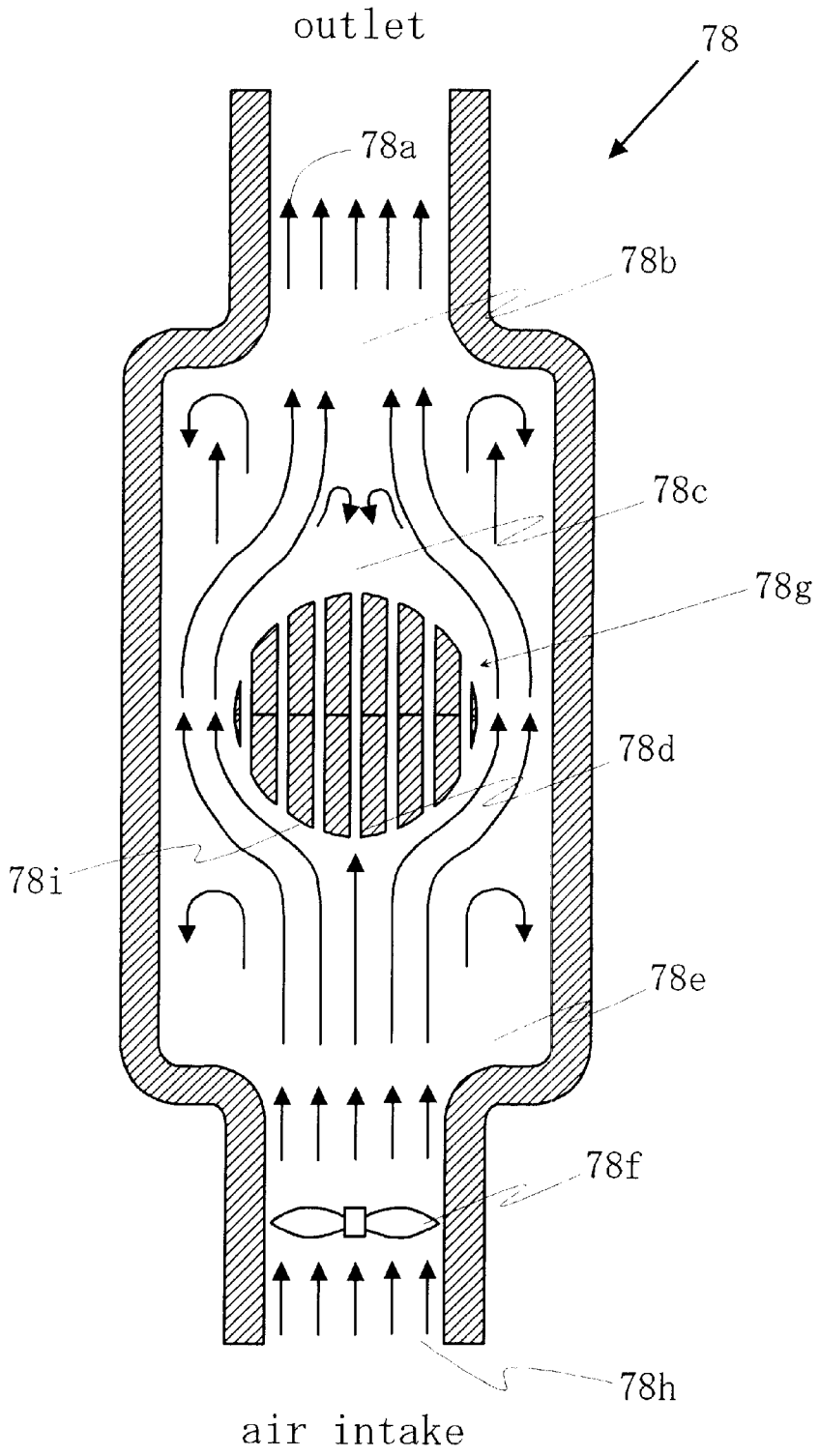
FIG. 40 is a longitudinal cross-sectional view showing the combustion state of an object to be incinerated when an air streams is forcibly sent in a conventional incinerator.

The incinerator 5 having the structure shown in FIG. 6 is not an incinerator which forcibly sends air into the incinerator to burn and incinerate the object to be incinerated like an incinerator illustrated in FIG. 40 but an incinerator having the structure such that a suction fan 5*b* for sucking smoke or combustion heat generated at the time of incinerating the object to be incinerated 5*g* in the incinerator 5 is attached to the outlet 5*a*.

According to the method by which the object to be incinerated 5*g* is burned and incinerated in the incinerator 5 while sucking air by the suction fan 5*b* attached to the outlet 5*a*, fresh air is sucked from an air intake 5*h* into the incinerator 5 and air enters the pores 5*e* formed to the object to be incinerated 5*g* so that the inside of the object to be incinerated 5*g* can be completely burned up in the incinerator 5 such as shown in FIG. 6.

When burning up the object to be incinerated 5*g* by such a suction method, air does not stagnate at a position 5*f* in the vicinity of the air intake 5*h*, and air flows toward the outlet 5*a*, thereby generating no disturbance of air at the rear portion 5*d* of the object to be incinerated 5*g*. Therefore, the object to be incinerated 5*g* can be completely burned up even to the inside thereof. As shown in FIG. 7, the tabular ceramics filter 1 is attached to the suction fan 6*b* disposed to the outlet 6*a* so as to be close to the object to be incinerated 5*g* in the incinerator 5 having the structure shown in FIG. 6.

Attaching the tabular ceramics filter 1 to the outlet 6*a* can completely remove a harmful substance such as dioxin generated by incineration of the object to be incinerated 5*g*. Reference numeral 6*c* denotes a flow of air; 6*d*, a rear portion; 6*e*, a pore; 6*f*, a position in the vicinity of an air intake; and 5*h*, an air intake.

Figure 8:
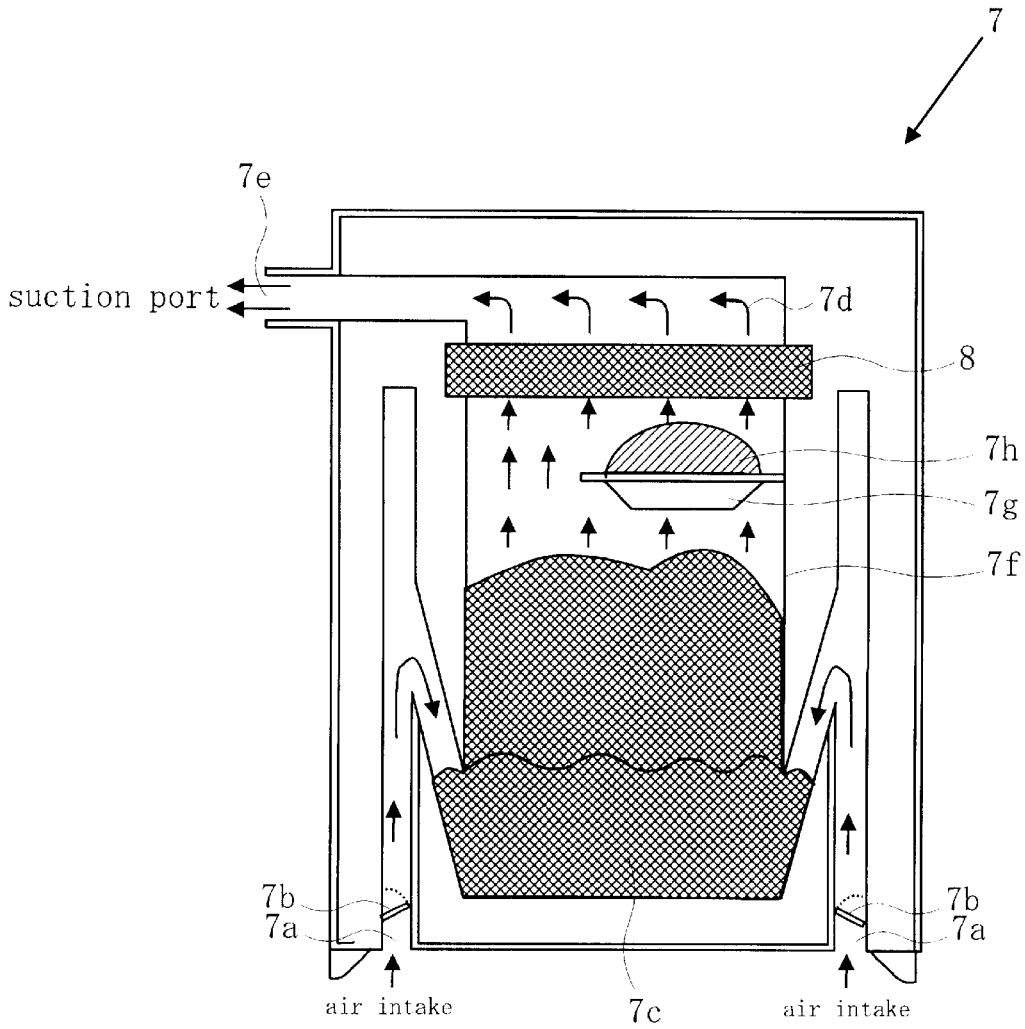
FIG. 8 is a longitudinal cross-sectional view showing the incinerator with a ceramics filter according to the present invention.
Figure 9:
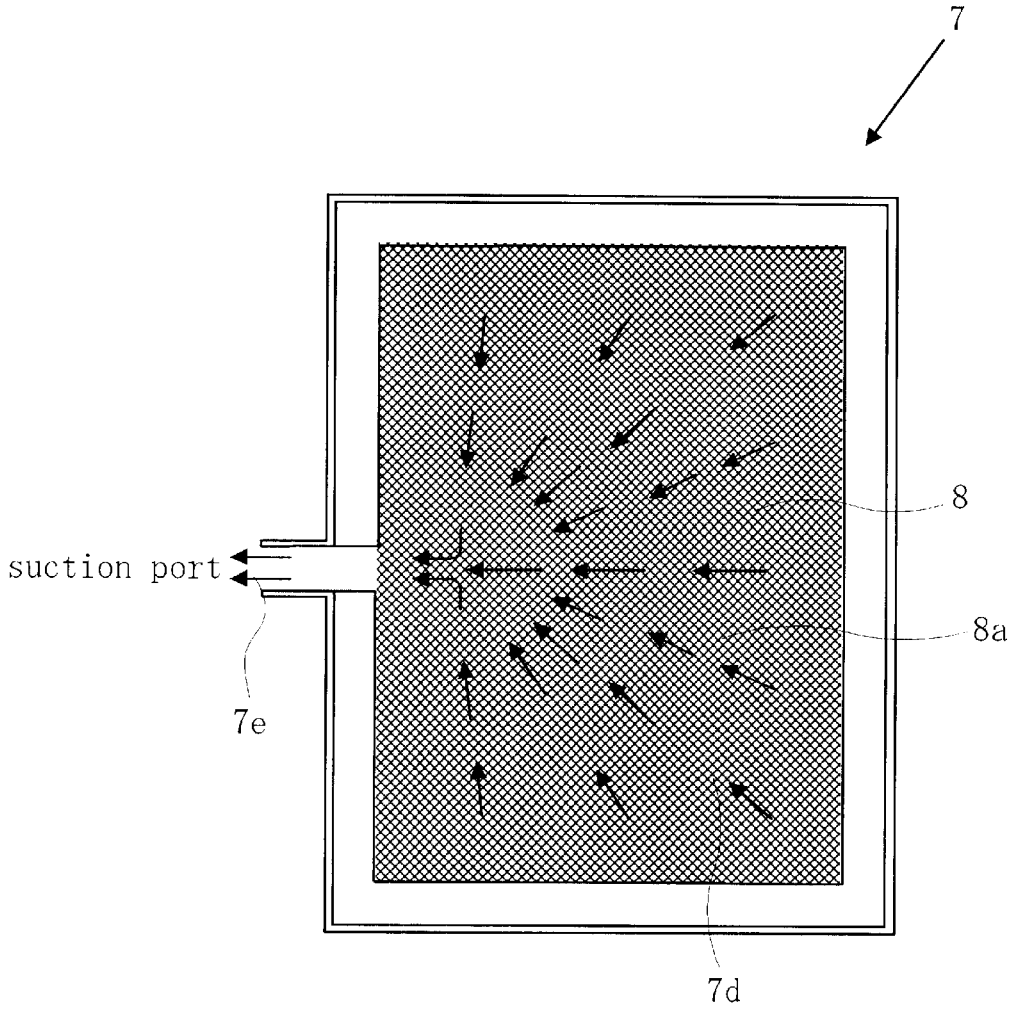
FIG. 9 is a transverse cross-sectional view showing the incinerator with a ceramics filter according to the present invention.

FIGS. 8 to 15 are views showing an incinerator having the structure in which the tabular ceramics filter is attached in the incinerator which is the incinerator with a ceramics filter according to the invention of the present application. FIGS. 8 and 9 show the incinerator capable of dealing with macromolecule incineration which is suitable for burning up a high polymer object to be incinerated. FIG. 8 is a longitudinal cross-sectional view and FIG. 9 is a transverse cross-sectional view.

Figure 10:
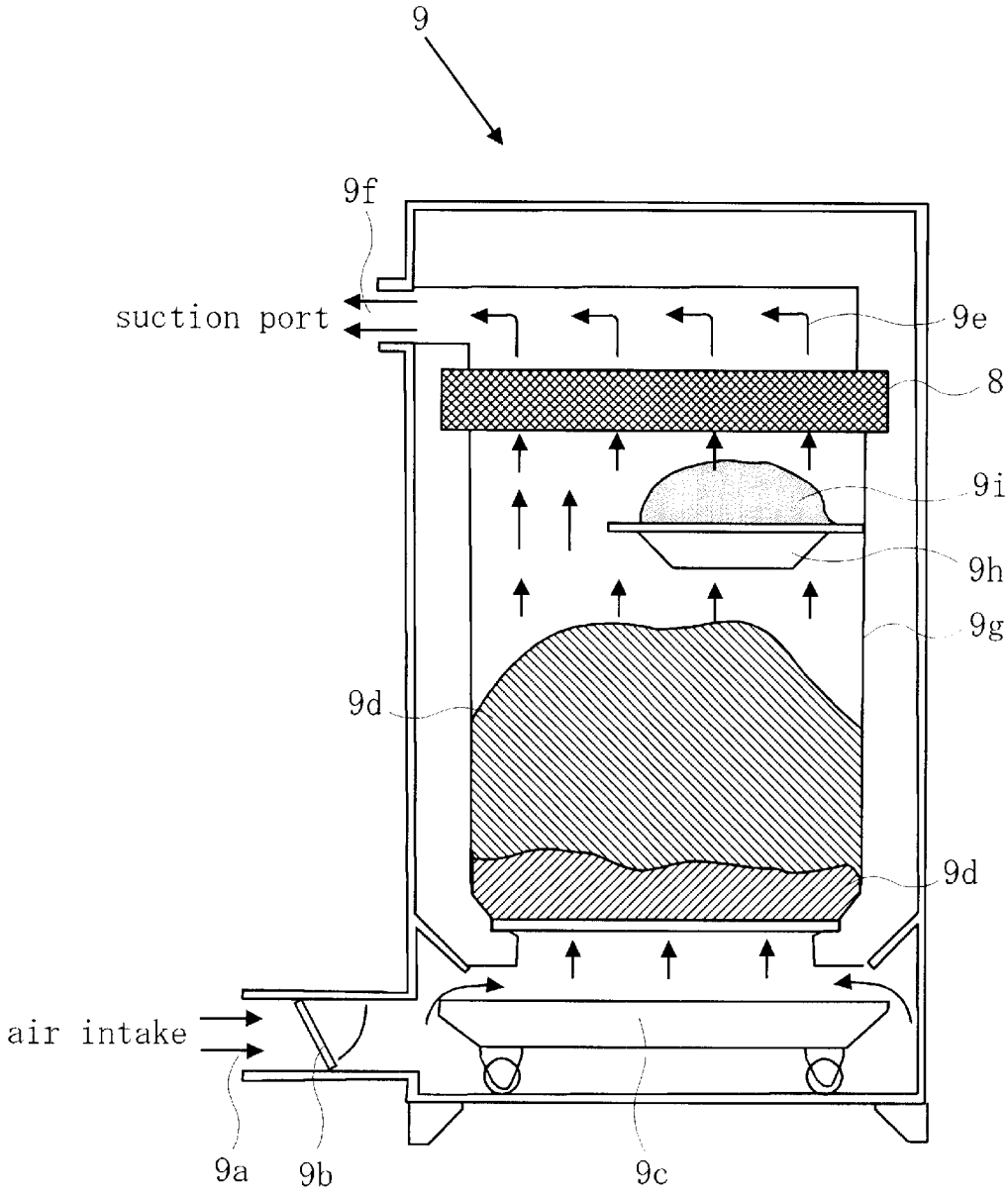
FIG. 10 is a longitudinal cross-sectional view showing another embodiment of the incinerator with a ceramics filter according to the present invention.
Figure 11:
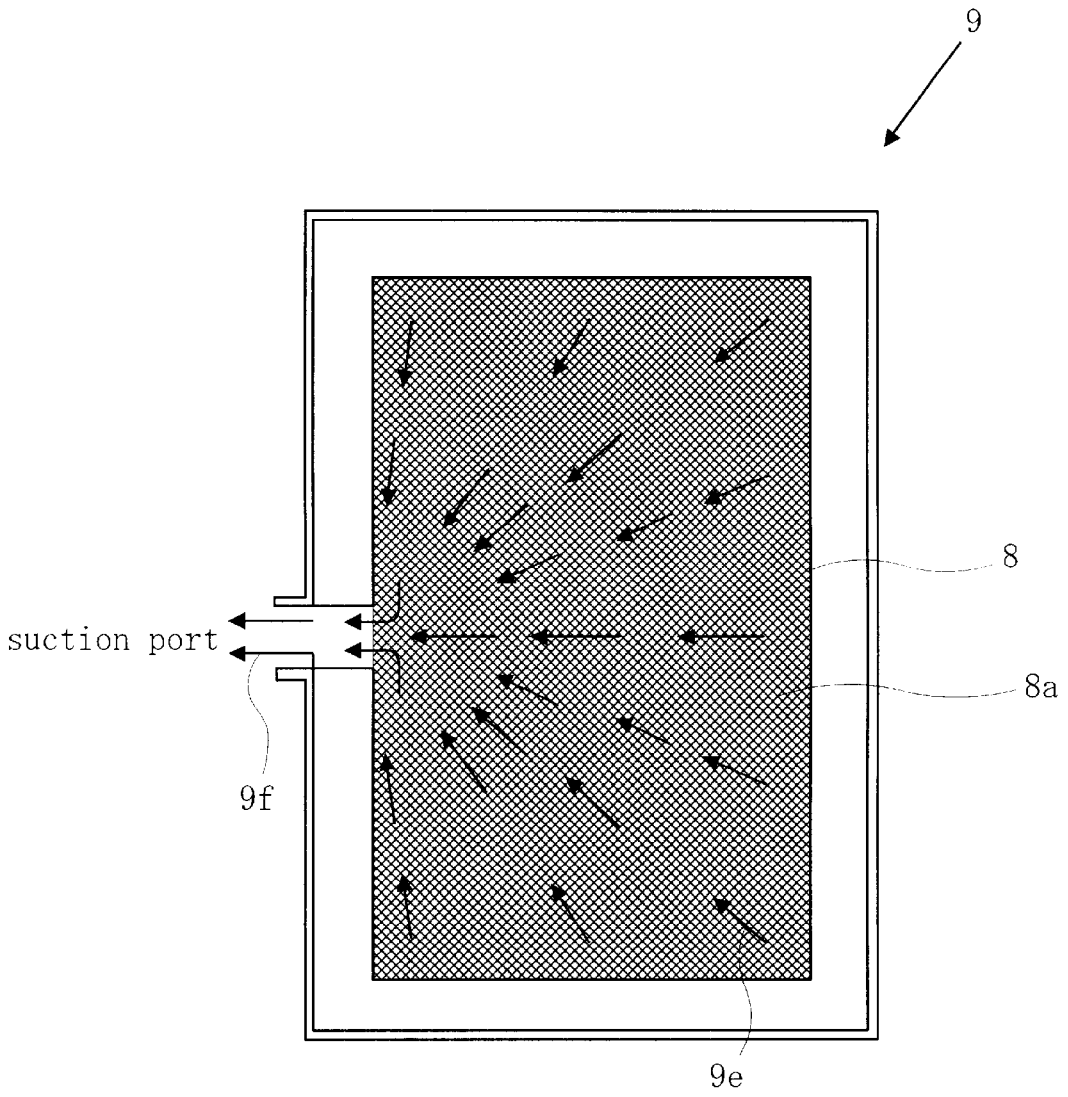
FIG. 11 is a transverse cross-sectional view showing another embodiment of the incinerator with a ceramics filter according to the present invention.
Figure 12:
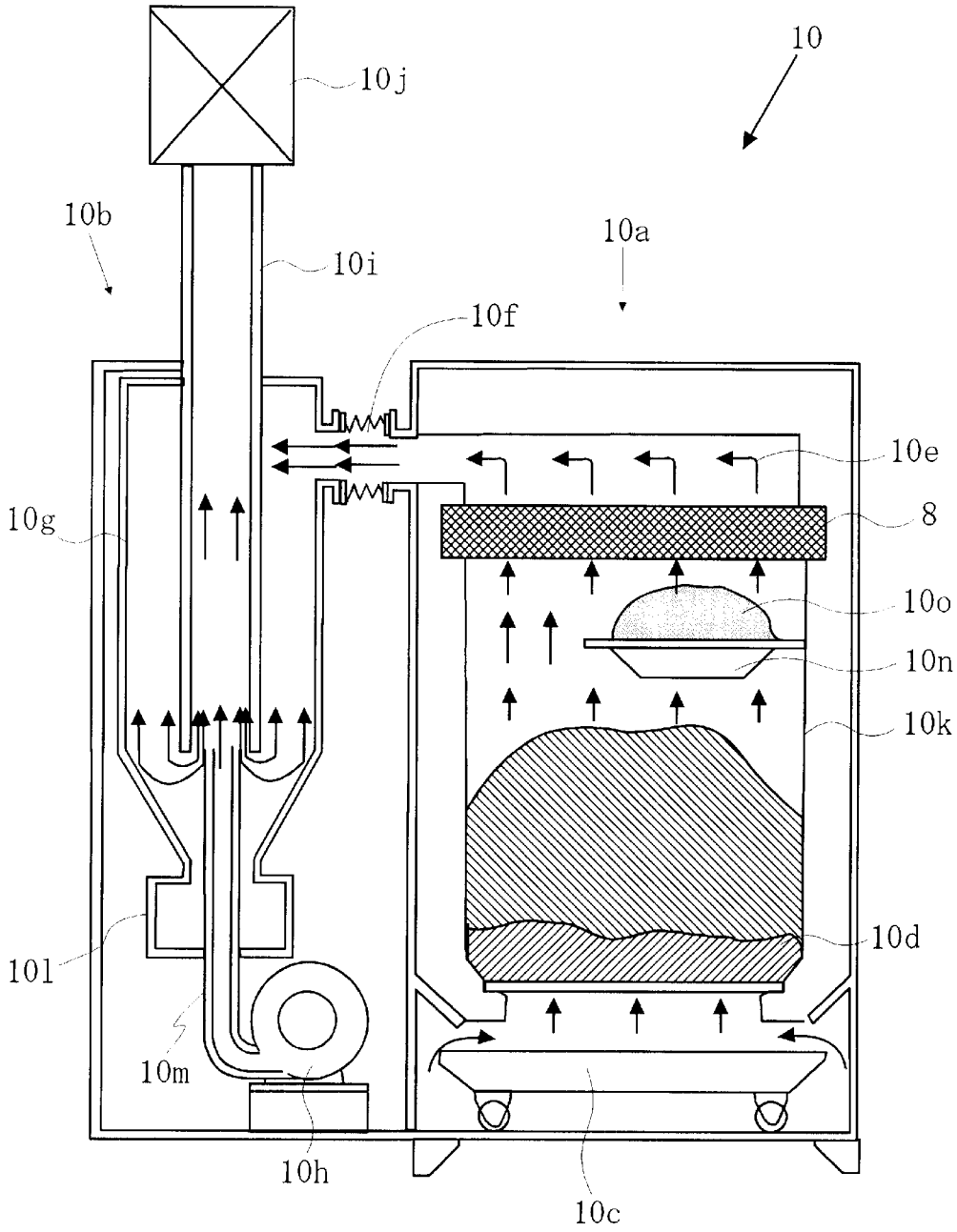
FIG. 12 is a longitudinal cross-sectional view showing another embodiment of the incinerator with a ceramics filter according to the present invention.
Figure 13:
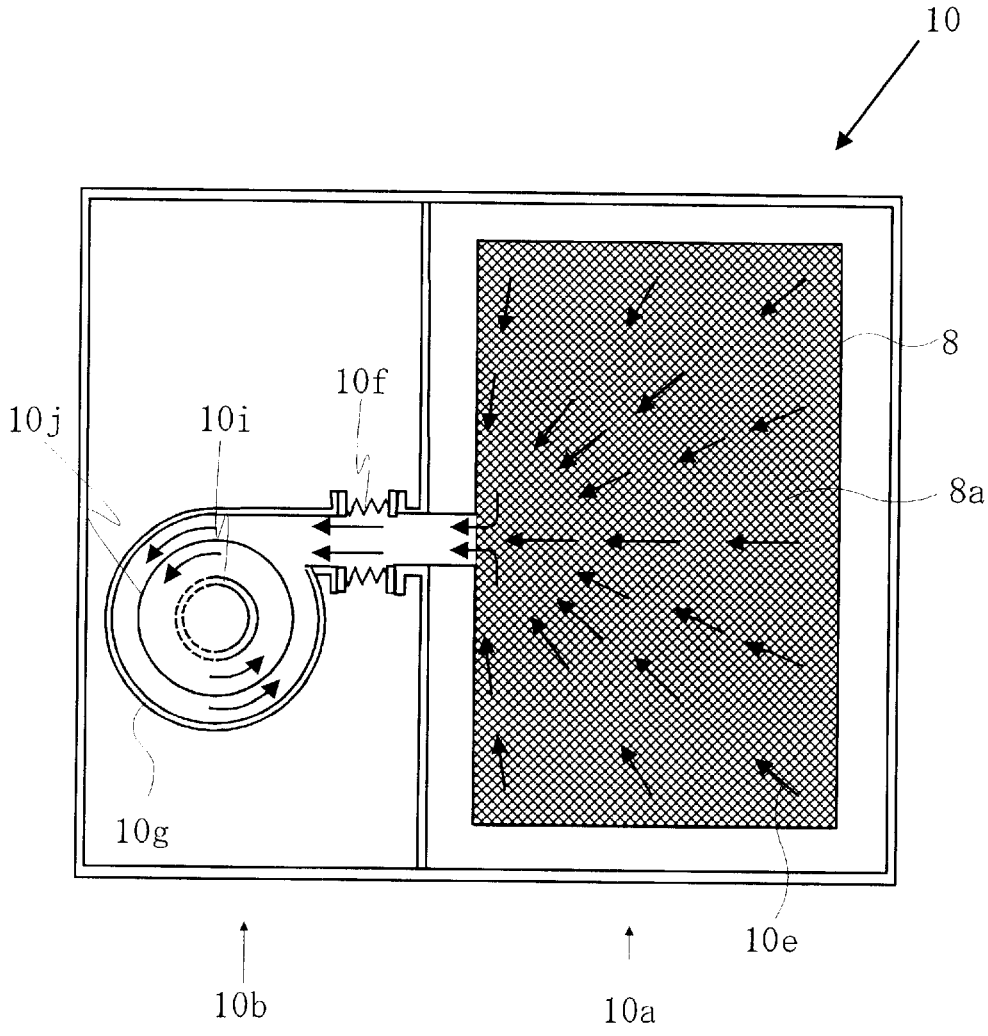
FIG. 13 is a transverse cross-sectional view showing another embodiment of the incinerator with a ceramics filter according to the present invention.

FIGS. 10 and 11 are views showing an incinerator for burning up general refuse which is suitable for incineration of general refuse. FIG. 10 is a longitudinal cross-sectional view and FIG. 11 is a transverse cross-sectional view. FIGS. 12 and 13 are view showing a basic apparatus of an incinerator with a ceramics filter according to the present invention. FIG. 12 is a longitudinal cross-sectional view and FIG. 13 is a transverse cross-sectional view.

Figure 14:
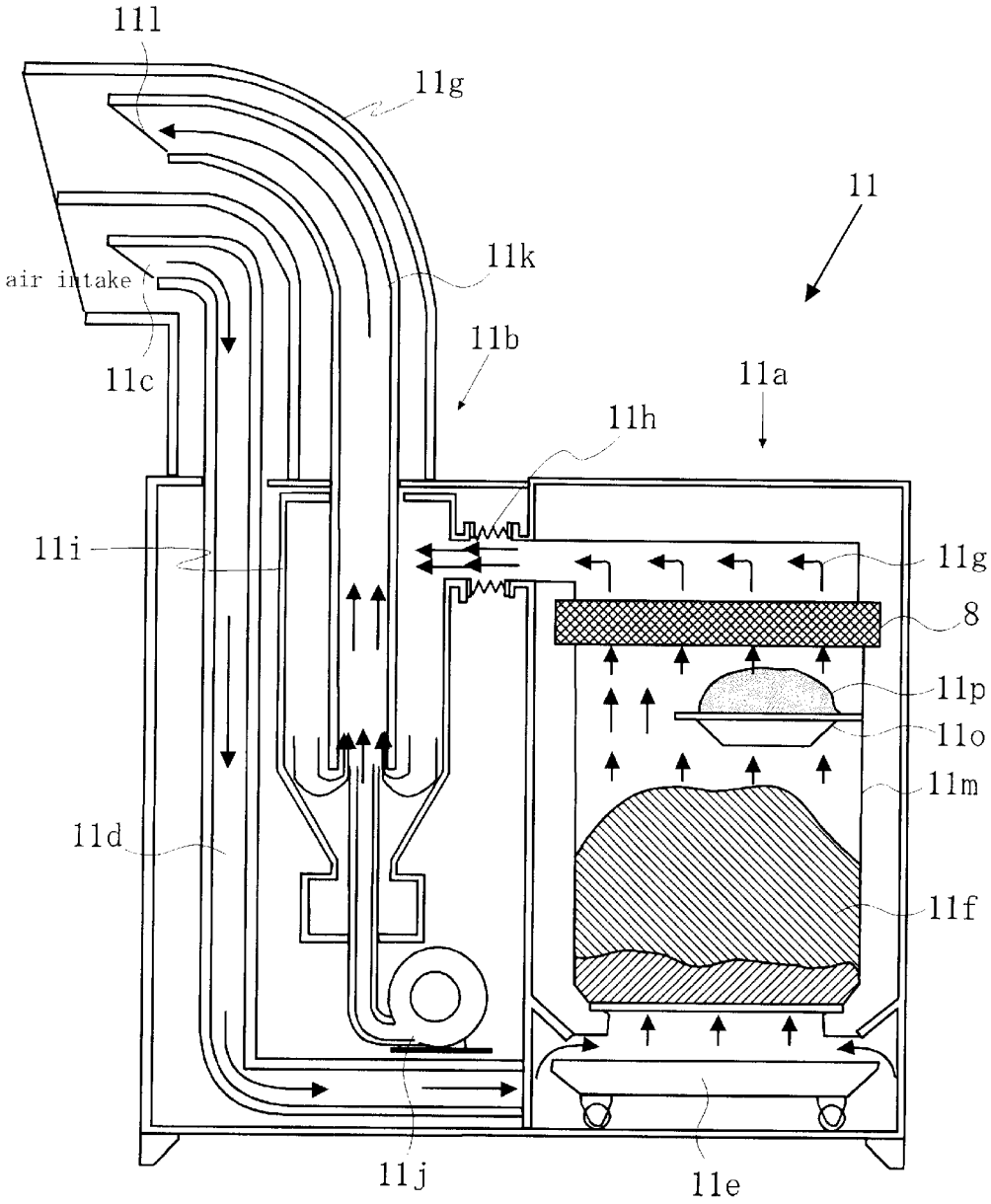
FIG. 14 is a longitudinal cross-sectional view showing another embodiment of the incinerator with a ceramics filter according to the present invention.
Figure 15:
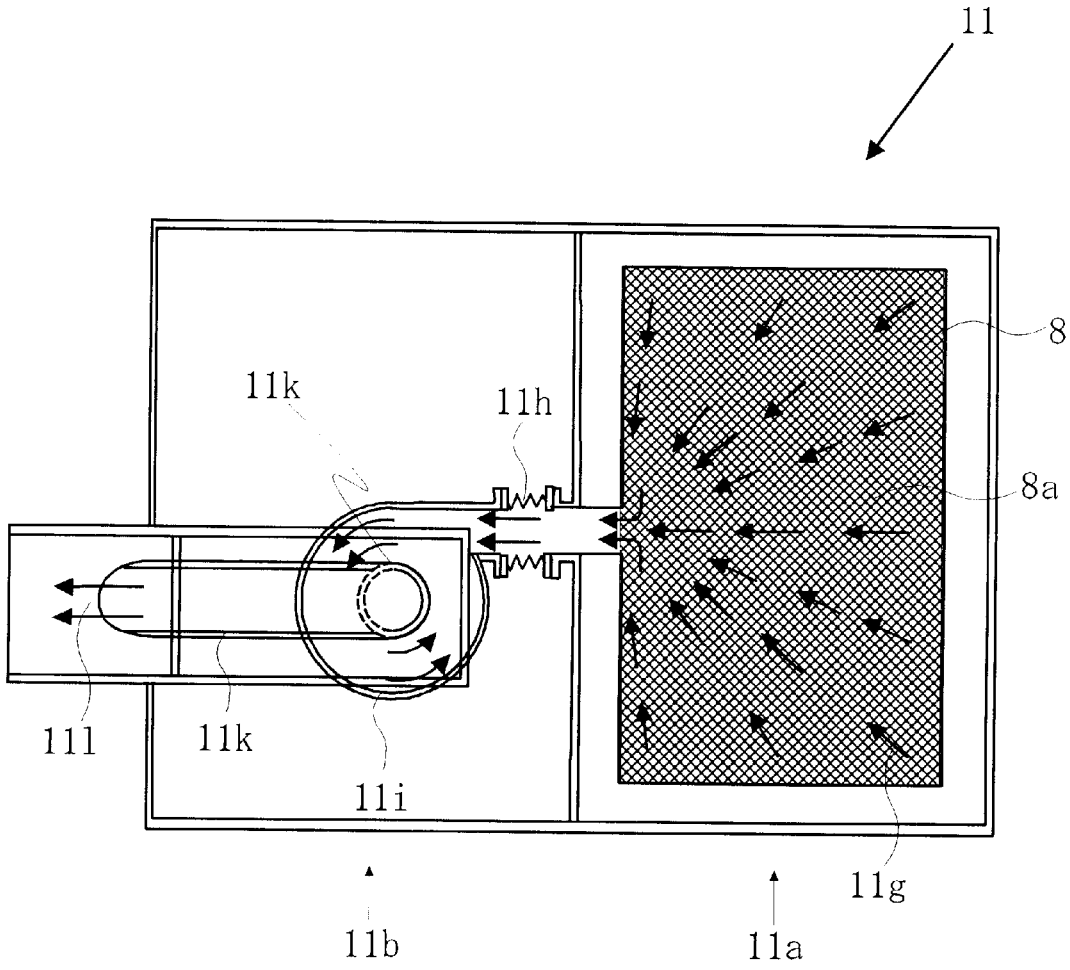
FIG. 15 is a transverse cross-sectional view showing another embodiment of the incinerator with a ceramics filter according to the present invention.

FIGS. 14 and 15 are views showing a basic incinerator having the structure such that air is sucked from the outside of the incinerator with a ceramics filter according to the invention of the present application. FIG. 14 is a longitudinal cross-sectional view and FIG. 15 is a transverse cross-sectional view.

FIGS. 16 to 19 show other embodiments of the incinerator with a ceramics filter according to the invention of the present application. That is, these are views showing the incinerators having the tabular ceramics filter and the spherical ceramics filter attached thereto.

Figure 33:
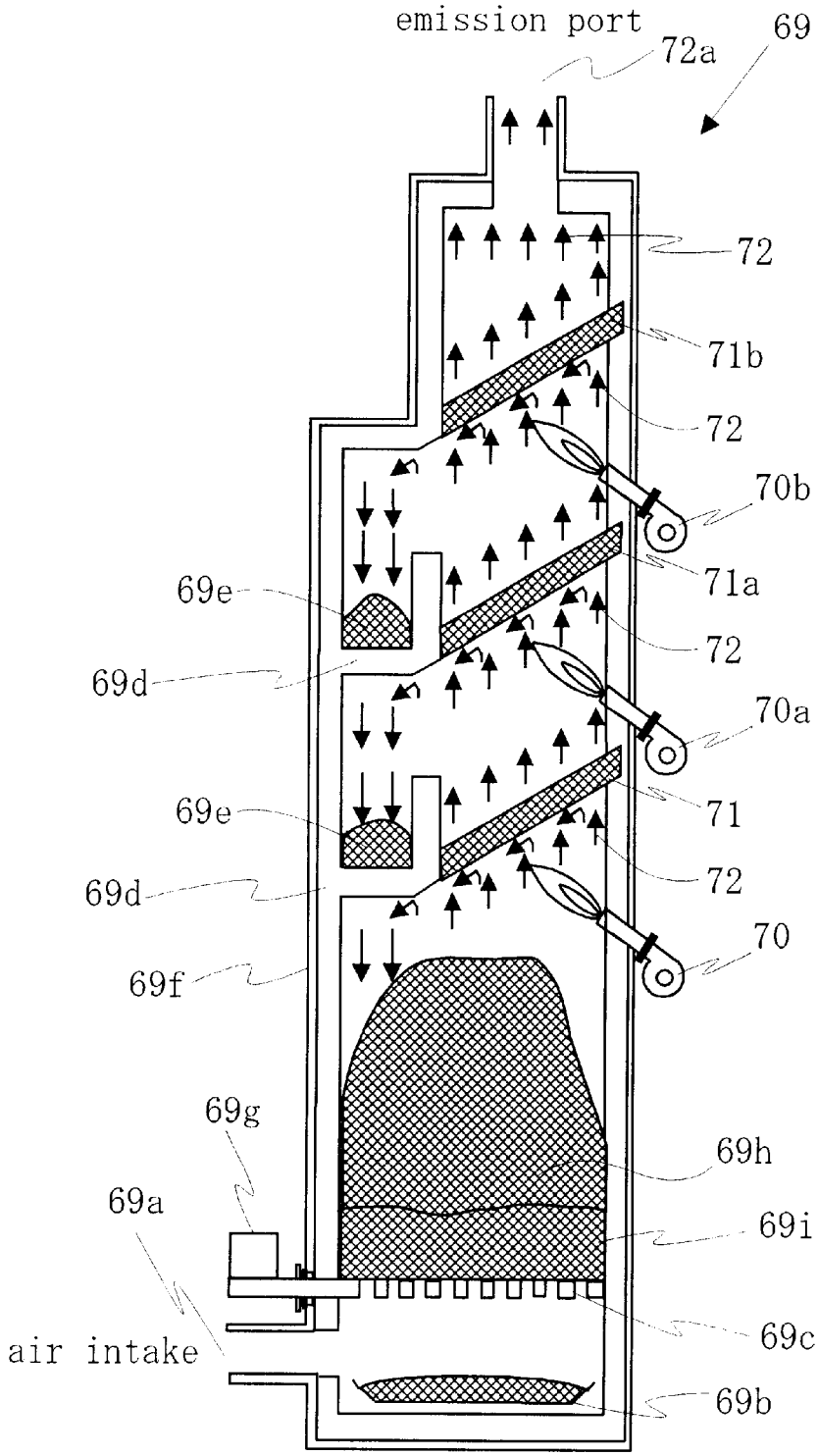
FIG. 33 is a longitudinal cross-sectional view showing the state where a tabular ceramics filter is attached to the incinerator with a ceramics filter according to the present invention in the multistage manner.
Figure 34:
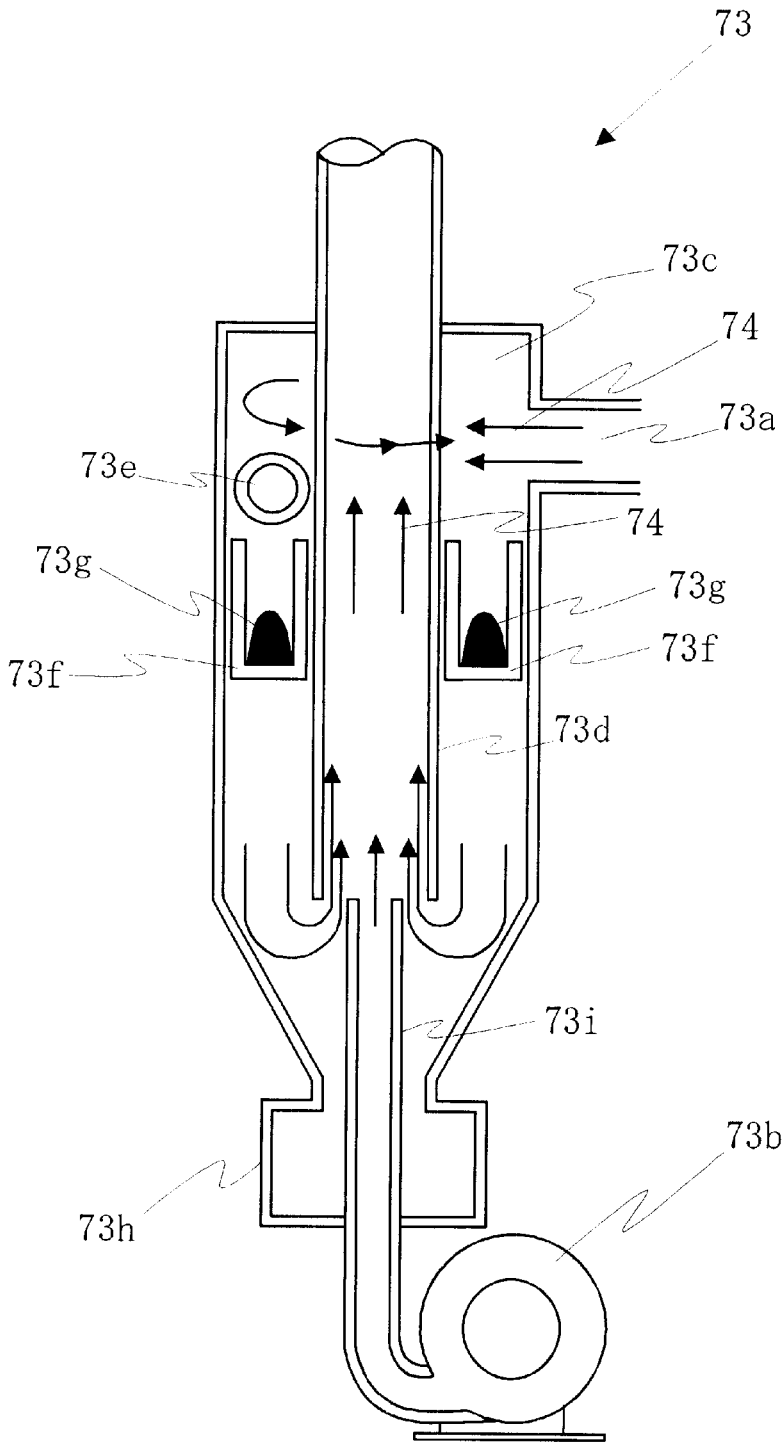
FIG. 34 is a longitudinal cross-sectional view showing a cyclone with a burner attached to the incinerator with a ceramics filter according to the present invention to be used.
Figure 35:
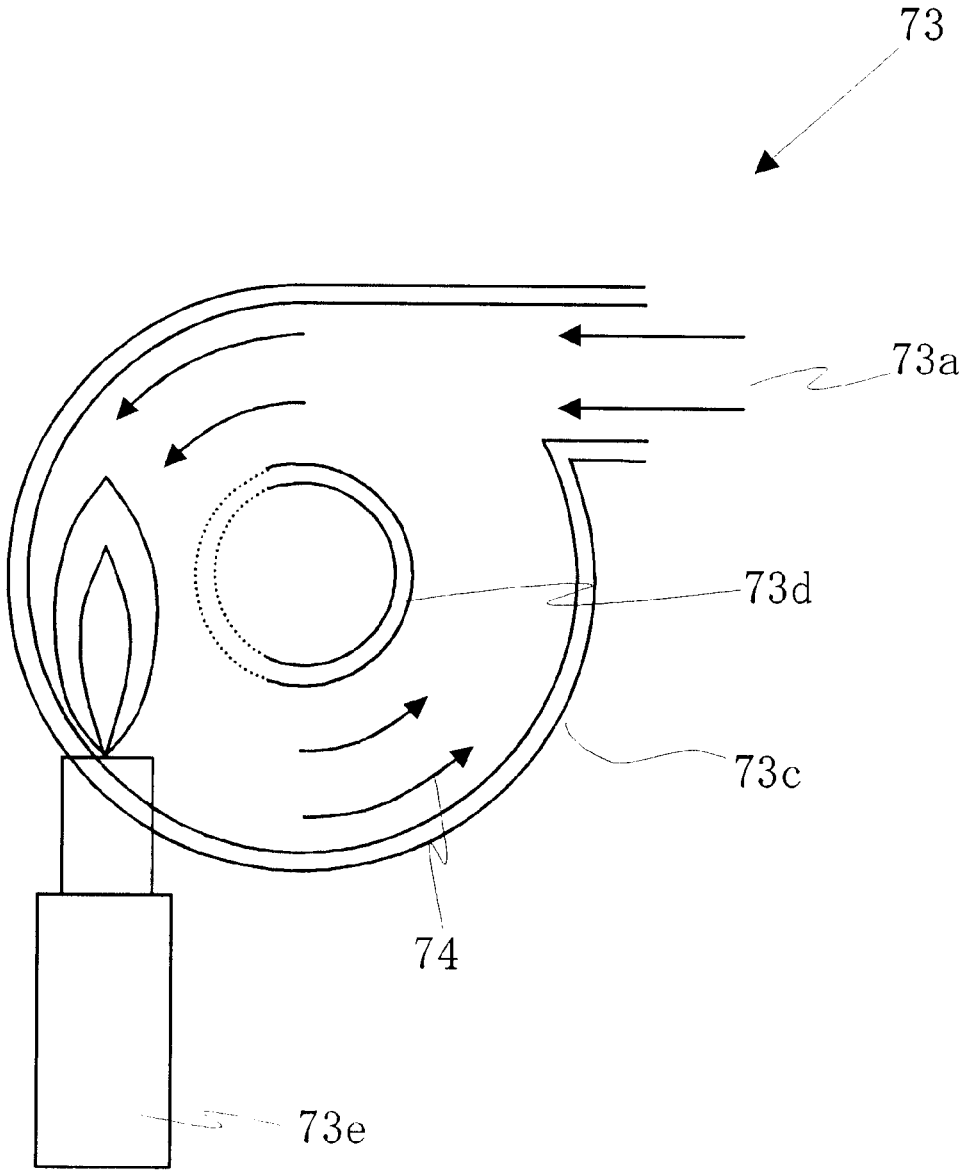
FIG. 35 is a longitudinal cross-sectional view of a cyclone with a burner attached to the incinerator with a ceramics filter according to the present invention to be used.

FIGS. 20 to 32 are views showing ceramics filters having various shapes which are attached to the incinerator with a ceramics filter according to the present invention. FIG. 33 is a view showing another embodiment of the incinerator with a ceramics filter according to the invention of the present application. FIGS. 34 and 35 are views showing a cyclone used being attached to the incinerator with a ceramics filter according to the invention of the present application.

Figure 36:
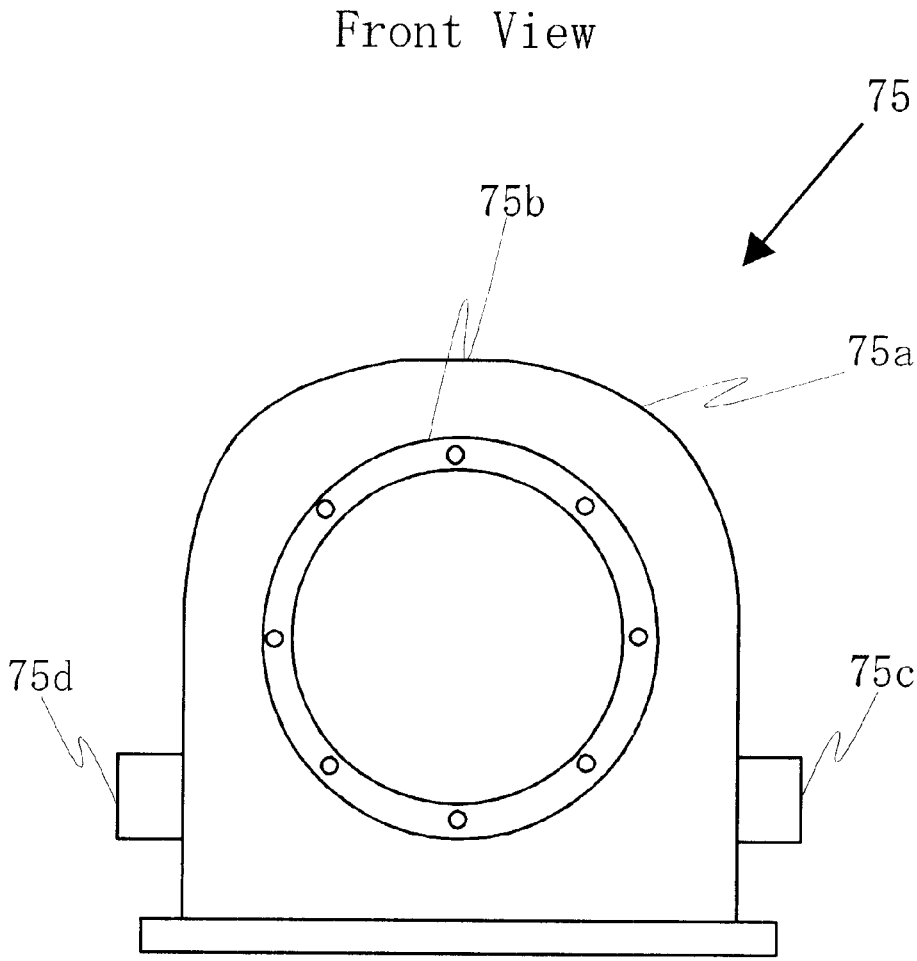
FIG. 36 is a front view of a vacuum pump attached to the incinerator with a ceramics filter according to the present invention for suction.
Figure 37:
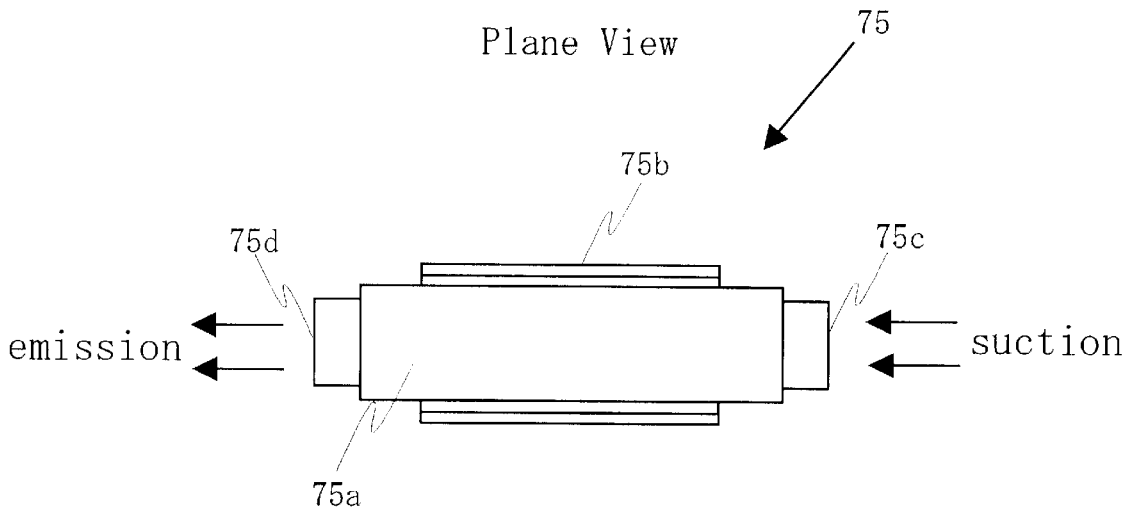
FIG. 37 is a plan view of a vacuum pump attached to the incinerator with a ceramics filter according to the present invention for suction.
Figure 38:
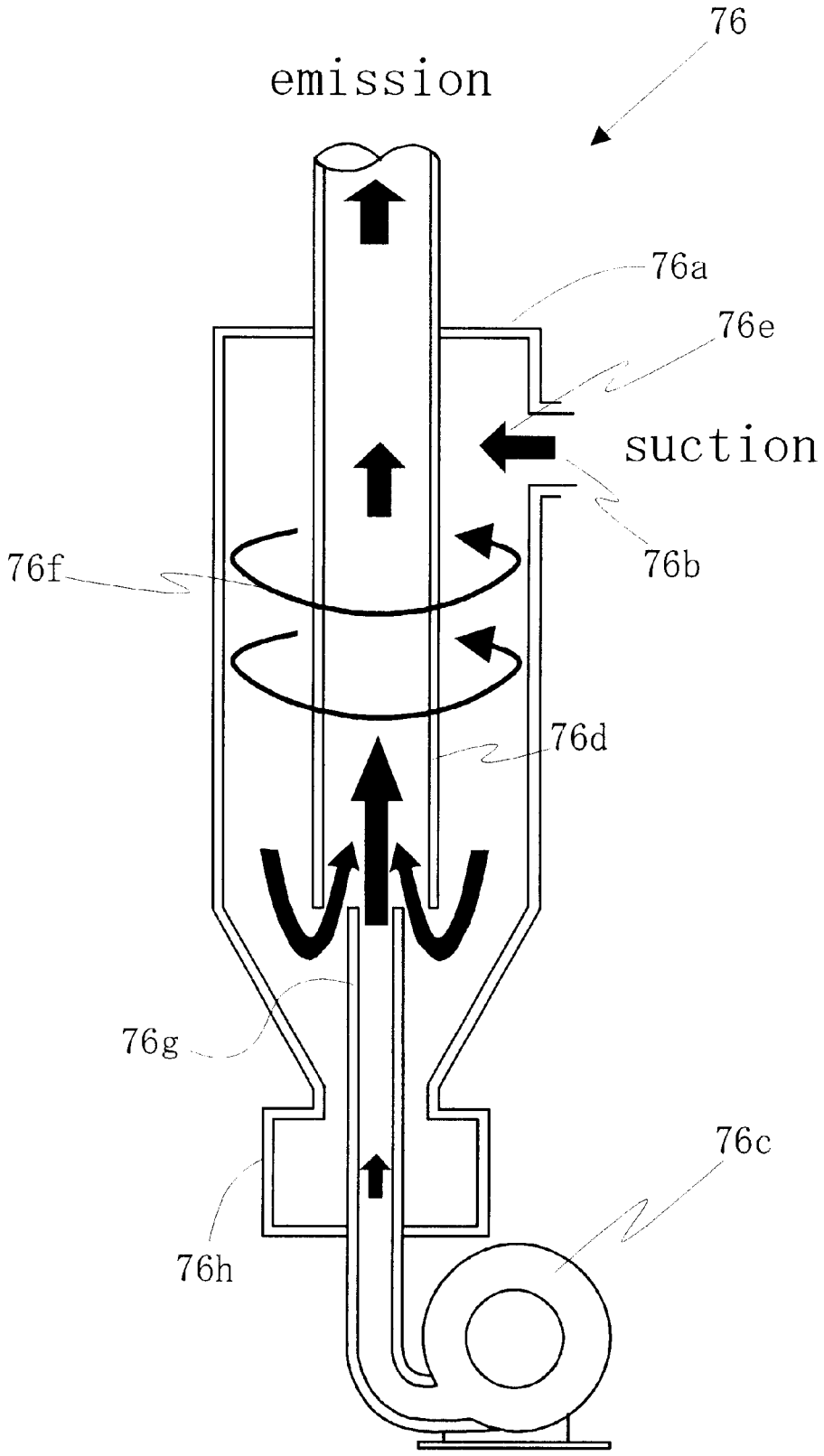
FIG. 38 is a longitudinal cross-sectional view showing a cyclone attached to the incinerator with a ceramics filter according to the present invention to be used.

FIGS. 36 and 37 are views showing a vacuum pump for suction which is attached to the incinerator with a ceramics filter according to the invention of the present application to be used, and FIG. 38 is a view showing a cyclone attached to the incinerator with a ceramics filter according to the present invention to be used.

FIG. 8 is a longitudinal cross-sectional view showing an incinerator corresponding macromolecule which is the incinerator with a ceramics filter according to the present invention, and FIG. 9 is a transverse cross-sectional view of an incinerator corresponding macromolecule which is the incinerator with a ceramics filter according to the present invention.

As shown in FIG. 8, the incinerator with a ceramics filter 7 in this example has air intakes 7*a* provided to the right and left lower portions of the incinerator 7. When smoke, combustion hot air and the like generated by combustion of the object to be incinerated 7*c* in the combustion chamber 7*f* is sucked from the suction port 7*e,* the check valves 7*b* on the both sides are opened and fresh air enters the combustion chamber 7*f* from the air intakes 7*a*. The air which has entered the combustion chamber 7*f* is absorbed into the suction port 7*e* while being mixed with molecules of the object to be incinerated 7*c* to perform combustion. The arrow in FIG. 8 shows a flow of air 7*d*.

When smoke, combustion hot air and the like having passed through fine pores 8*a* formed to the ceramics filter 8 is sucked in the suction port 7*e* by the blast fan or blower and the like, only the macro molecules contained in smoke, combustion hot air and the like can not pass through the ceramics filter 8 and adhere to the pores 8*a* of the ceramics filter 8. Thus, the macro molecules can not be discharged into the air. As shown in FIG. 9, in the ceramics filter 8, only the molecules of smoke, combustion hot air and the like having passed through the pores 8*a* of the filter is sucked in the suction port 7*e* to be discharged into the air. As shown in FIG. 8, an oast 7*g* is installed under the ceramics filter 8 in the combustion chamber 7*f*, and an object to be dried 7*h* containing a large amount of water is dried by hot air generated by combustion of the object to be incinerated 7*c*.

FIG. 10 is a longitudinal cross-sectional view of an apparatus dealing with general refuse which is the incinerator with a ceramics filter according to the present invention, and FIG. 11 is a transverse cross-sectional view of an apparatus dealing with general refuse which is the incinerator with a ceramics filter according to the present invention. An arrow indicates a flow of air 9*e* in a combustion chamber 9*g* in the incinerator with a ceramics filter 9.

As shown in FIG. 10, in the incinerator with a ceramics filter 9, an air intake 9*a* is provided to the lower portion of the incinerator 9, a tabular ceramics filter 8 is provided to the upper portion of the combustion chamber 9*g*, and a suction port 9*f* through which smoke, combustion hot air and the like generated in the combustion chamber 9*g* are sucked or discharged is provided above the tabular ceramics filter 8. When smoke, combustion hot air and the like generated in the combustion chamber 9*g* is sucked by a blast fan or blower directly set at the suction port 9*f* through the suction port 9*f*, a vacuum is formed in the combustion chamber 9*g*, and a check valve 9*b* provided to the air intake 9*a* is opened so that the outside air is taken from the air intake into the combustion chamber 9*g*. The outside air taken in the combustion chamber 9*g* by the air intake 9*a* performs combustion while being mixed with molecules of an object to be incinerated 7*c*, and smoke, combustion hot air and the like is sucked to the suction port 9*f*.

When the object to be incinerated 9*d* is burned up, smoke, combustion hot air and the like pass through fine pores 8*a* formed to the ceramics filter 8 provided to the upper portion of the combustion chamber 9*g*, and the combustion hot air flows in a direction of the suction port 9*f* like the flow of air 9*e* indicated by an arrow. When the combustion hot air such as smoke and the like passes through the fine pores 8*a* formed to the ceramics filter 8, only molecules whose size is smaller than the pore 8*a* formed to the ceramics filter 8 can pass through the pores 8*a* of the ceramics filter 8. If the size of the molecule is larger, it can not pass through the pore 8*a* formed to the ceramics filter 8. An ash receiving chamber having an ashpan 9*c* set therein is provided below the combustion chamber 9*g* of the incinerator 9. This ashpan 9*c* can be accessible from the incinerator 9. Further, an oast 9*h* is set in the combustion chamber 9*g* under the ceramics filter 8 and can dehydrate an object to be dried 9*i* containing a large amount of water.

As show in FIG. 11, the molecule having passed through the filter pore 8*a* formed to the ceramics filter 8 is absorbed into the suction port 9*f*. However, this molecule dioxin as a harmful substance has the size larger than the fine pore 8*a* formed to the ceramics filter 8, dioxin adheres to the pore 8*a* of the ceramics filter 8.

FIG. 12 is a longitudinal cross-sectional view of a basic simplified incinerator which is the incinerator with a ceramic filter according to the present invention, and FIG. 13 is a transverse cross-sectional view of the basic simplified incinerator which is the incinerator with a ceramic filter according to the present invention. An arrow indicates a direction of an air flow 10*e* which is taken into the incinerator with a ceramics filter of this example to flow in a combustion chamber 10*k* and a cyclone chamber 10*g* of a cyclone 10*b*.

As shown in FIGS. 12 and 13, the incinerator with a ceramics filter 10 of this example consists of the combustion chamber 10*a* and a cyclone 10*b*. An object to be incinerated 10*d* to be burned up in the incinerator 10*a* is consumed in the combustion chamber 10*k,* and smoke, hot air and the like generated from combustion in the combustion chamber 10*k* pass through fine pores 8*a* formed tot he ceramics filter 8. The molecule of dioxin which is a harmful substance contained in smoke, combustion hot air and the like adheres to the pores 8*a* of the ceramics filter when trying to pass through the pores 8*a*. The molecules other than those of dioxin, which can pass through the pores 8*a* formed to the ceramics filter 8, are separated and screened from those which can not pass through the same, and only the molecules having passed through the pores 8*a* of the ceramics filter 8 are sucked into the cyclone chamber 10*g* of the cyclone 10*b*. A cooling system for cooling down is attached at a connection portion 10*f*, and smoke, combustion hot air and the like generated in the combustion chamber 10*k* are cooled down at the connection portion 10*f* to be sucked into the cyclone chamber 10*g*.

In this manner, smoke, combustion hot air and the like are separated from dioxin and others which are harmful substances contained in smoke, combustion air and the like. That is, only fine molecules whose size is smaller than that of the pore 8*a* formed to the ceramics filter 8 are caused to pass through the pore 8*a*. The screened smoke, combustion hot air and the like are sucked into the cyclone chamber 10*g* of the cyclone 10*b*.

In the incinerator with a ceramics filter 10 of this example, an end of an air duct 10*m* of a blower 10*h* is inserted to the lower portion of an exhaust duct 10*i* set in the cyclone chamber 10*g* of the cyclone 10*b*. When the blower 10*h* is driven, and air is sent from the air duct 10*m* into the exhaust tube 10*i* of the cyclone chamber 10*g* as an air stream, and the sent air is forcibly discharged from the outlet 10*j* into the air, thereby forming a vacuum in the cyclone chamber 10*g*.

Therefore, an air pressure in the cyclone chamber 10*g* becomes lower than that in the combustion chamber 10*k*, and there occurs a difference in pressure between the combustion chamber 10*k* and the cyclone chamber 10*g*. Thus, smoke, combustion hot air and the like in the cyclone chamber 10*g* pass through the connection portion 10*f* having the cooling system attached thereto to be sucked into the cyclone chamber 10*g* (this will be referred to as an ejector effect hereinafter). As shown in FIG. 13, smoke, combustion hot air and the like screened and sucked in the cyclone chamber 10*g* move down while rotating spirally in the cyclone chamber 10*g* of the cyclone 10*b*. They are then sucked from the lower end of the exhaust tube 10*i* and discharged from the outlet 10*j* of the exhaust tube 10*i* into the air. Reference numeral 101 denotes a dust receiver. An oast 10*n* is set under the ceramics filter 8 provided in the combustion chamber 10*k* in order to dehydrate an object to be dried 10*o* containing a large amount of water.

FIG. 14 is a longitudinal cross-sectional view of an apparatus such that a suction portion is added to the combustion portion having an intake pipe arranged in the incinerator with a ceramics filter according to the present invention, and FIG. 15 is a transverse cross-sectional view showing a filter portion of the incinerator with a ceramics filter of this example.

As shown in FIGS. 14 and 15, the incinerator with a ceramics filter 11 of this example is constituted by a combustion portion 11*a* and a suction portion 11*b*. The combustion portion 11*a* consists of an intake pipe 11*d* having an air intake 11*c* for taking in air; a combustion chamber 11*m*; a pan 11*e* for receiving incinerated ash; and a ceramics filter 8 for screening combustion smoke in the molecule level.

The suction portion 11*b* is made up of: an intake pipe 11*d* having an air intake 11*c* for taking air to a pan 11*e* set to the lower portion of the combustion portion 11*a*; a cyclone 11*i* in which an exhaust duct 11*k* having an outlet 111 is provided; and a blower 11*j* for inserting the end of the air duct 11*n* to the lower end of the exhaust duct 11*k*. The intake pipe 11*d* is bent and one end of the intake pipe 11*d* is connected to the lower portion of the combustion portion 11*a*.

In the combustion chamber 11*m*, an oast 11*o* for dehydrating an object to be dried 11*p* containing a large amount of water is so provided as to protrude to the combustion chamber 11*m*. The object to be dried 11*p* which contains a large amount of water and put on the oast 11*o* is dried by hot air generated by combustion of the object to be incinerated 11*f*.

Explaining the air flow in the incinerator with a ceramics filter of this example, the air flow 11*g* moves as indicated by an arrow. That is, when the object to be incinerated 11*f* is inflamed and the blower 11*j* is driven, since the air stream sent from the blower 11*j* is forcibly moved from the end of the air duct 11*n* into the exhaust duct 11*k*, smoke, combustion hot air and the like in the cyclone 11*i* are sucked from the lower end of the exhaust duct 11*k* having the cover and discharged from the outlet 111.

Then, they are forcibly discharged from the exhaust duct 11*k* into the air, and a vacuum is hence formed in the cyclone 11*i*. Therefore, as to smoke, combustion hot air and the like generated from the objected to be incinerated 11*f* and the object to be dried 11*p* in the combustion chamber 11*m* through the connection portion 11*h* having a cooling chamber provided thereto, only the molecules having passed through the pores 8*a* of the ceramics filter 8 are discharged from the exhaust duct 11*k*, and dioxin as a harmful substance which can not pass through the pores 8*a* formed to the ceramics filter 8 is removed and sucked in the cyclone 11*i*. As a result, a vacuum is also formed in a chamber in which the pan 11*e* is set, and the outside air from the air intake 11*c* passes through the intake pipe 11*d* to flow into the chamber with the pan 11*e* in which a vacuum is formed. Reference numeral 11*q* denotes a cover for preventing rain water from entering the intake pipe 11*d* and exhaust duct 11*k*.

Figure 16:
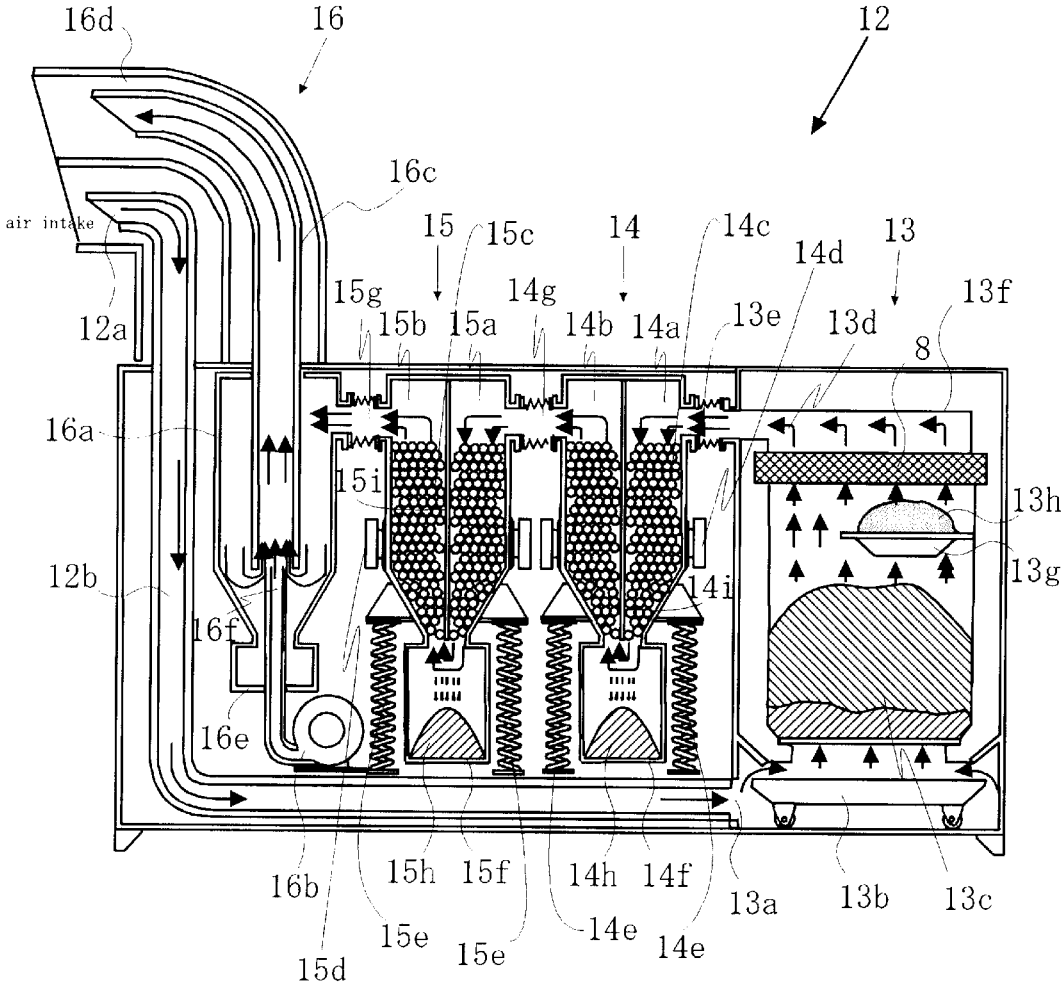
FIG. 16 is a longitudinal cross-sectional view showing another embodiment of the incinerator with a ceramics filter according to the present invention.
Figure 17:
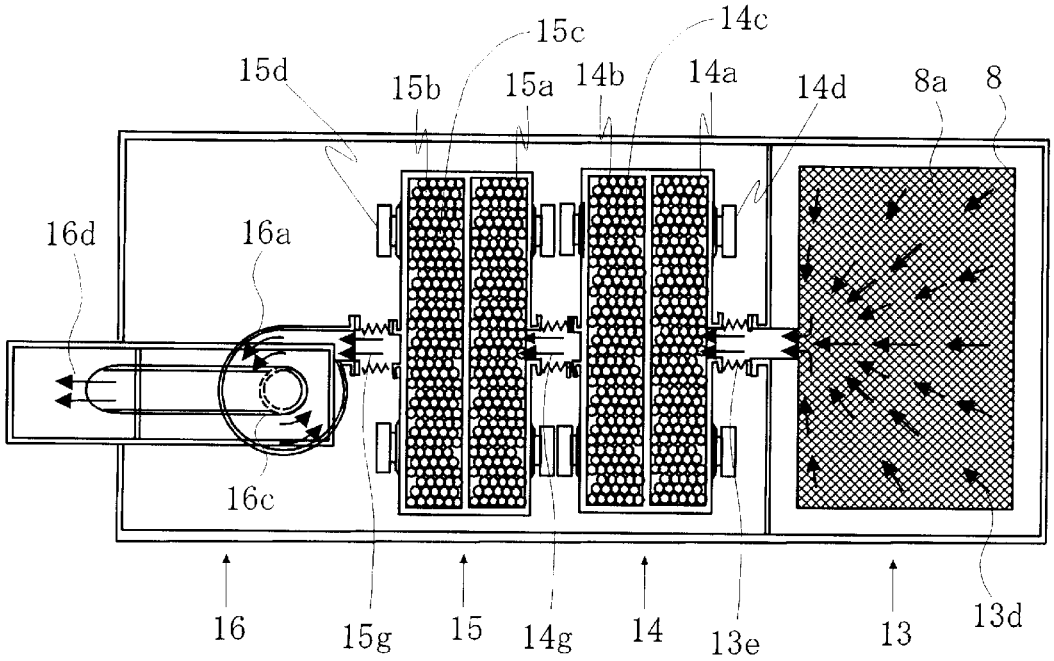
FIG. 17 is a transverse cross-sectional view showing another embodiment of the incinerator with a ceramics filter according to the present invention.

FIG. 16 is a longitudinal cross-sectional view showing the state in which the tabular ceramics filter and the spherical ceramics filter are attached to the incinerator with a ceramics filter according to the present invention, and FIG. 17 is a transverse cross-sectional view showing the state in which the tabular ceramics filter and the spherical ceramics filter are attached to the incinerator with a ceramics filter according to the present invention.

As shown in FIGS. 16 and 17, this example is made up of: a combustion portion 13 having the ceramics filter 8 provided thereto; a first filter 14 accommodating therein a plurality of spherical ceramics filter 14*c* formed into a granulated form; a second filter 15 similarly accommodating therein a plurality of spherical ceramics filters 15*c*; and a suction portion 16 having a cyclone 16*a*.

The incinerator with a ceramics filter 12 of this example has the structure for filtering smoke, combustion hot air and the like generated in the combustion portion 13 by three stages, i.e., the tabular ceramics filter 8, the first filter 14 accommodating therein the spherical ceramics filters 14*c* and the second filter 15 accommodating therein the spherical ceramics filters 15*c* which are the filter for removing harmful substances such as dioxin. This structure can completely remove dioxin and the like which is a harmful substance contained in smoke, combustion hot air and the like.

The combustion portion 13 is constituted by a bent intake pipe 12*b* having an air intake 12*a* for taking in air; a combustion chamber 13*f* to which an oast 13*g* for dehydrating an object to be dried 13*h* containing a large amount of water is attached; an ashpan 13*b* for receiving incinerated ash; and a tabular ceramics filter 8 for screening combustion smoke in the molecule level. The intake pipe 11*d* having the air intake 12*a* for taking in outside air is connected to an ash receiving chamber in which the ashpan 13*b* is set through the side portion of the cyclone 16*a* and the lower portions of the first filter 14 and the second filter 15 so that fresh air enters the ash receiving chamber from the inlet 13*a*.

As shown in FIGS. 16 and 17, both the first filter 14 and the second filter 15 are hollow cylinders, and the lower portion of each filter has a cone-like shape. There are partitions 14*i* and 15*i* in the first filter 14 and the second filter 15 in order to divide into right filter chambers 14*a* and 15*a* and left filter chambers 14*b* and 15*b*. A plurality of spherical ceramics filters 14*c* and 15*c* which are filters formed into a ball-like shape are accommodated in the right filter chambers 14*a* and 15*a* and the left filter chambers 14*b* and 15*b*.

The first filter 14 and the second filter 15 are supported by springs 14*e* and 15*e*, and to the lower portions of the first filter 14 and the second filter 15 are set storage boxes 14*f* and 15*f* for accommodating therein filtered materials which are harmful substances (dioxin) filtered by the first filter 14 and the second filter 15.

The suction portion 16 is constituted by: a cyclone 16*a*; a blower 16*b* having an air duct 16*f*; an exhaust duct 16*c* which is inserted into and attached to the cyclone 16*a*; and an outlet 16*d*. Smoke, combustion hot air and the like generated in the combustion portion 13 pass through the tabular ceramics filter 8, the connection portion 13*e* having a cooling chamber for cooling down, and the connection portion 14*g* from the inside of the first filter 14. They then enter the second filter 15 accommodating therein a plurality of spherical ceramics filters 15*c*.

Thereafter, they flow into the cyclone 16*a* through the connection portion 15*g* to be discharged from the exhaust duct 16*c*. Then, smoke, combustion hot air and the like filtered to contain no harmful substances are emitted from the outlet 16*d*. In this manner, smoke, combustion hot air and the like generated in the combustion chamber 13*f* circulate through the tabular ceramics filter 8 in the combustion portion 13, the first filter 14, the second filter 15, the cyclone 16*a* and the exhaust duct 16*c* in the mentioned order to be discharged.

The reason of such circulation is as follows. Since the air stream is sent from the end of the air duct 16*f* into the exhaust duct 16*c* through the lower end of the exhaust duct 16*c* by drive of the blower 16*b*, a vacuum is entirely formed in the cyclone 16*a*. Then, smoke, combustion hot air and the like cooled down in the connection portion 15*g* having the cooling chamber for cooling down flow from the second filter 15 into the cyclone 16*a* in such a manner that smoke, combustion hot air and the like in the combustion portion 13, the first filter 14 and the second filter 15 are sucked.

Harmful substances such as dioxin contained in smoke, combustion hot air and the like generated in the combustion chamber 13*f* can not pass through the pores 8*a* formed to the tabular ceramics filter 8 when trying to pass through the tabular ceramics filter 8. Only the smoke, combustion hot air and the like having passed through the filter 8 flow into the first filter 14 to be filtered by the second filter 15. Consequently, only the smoke, combustion hot air and the like from which harmful substances such as dioxin contained in the smoke, combustion hot air and the like are removed are discharged into the air.

Figure 18:
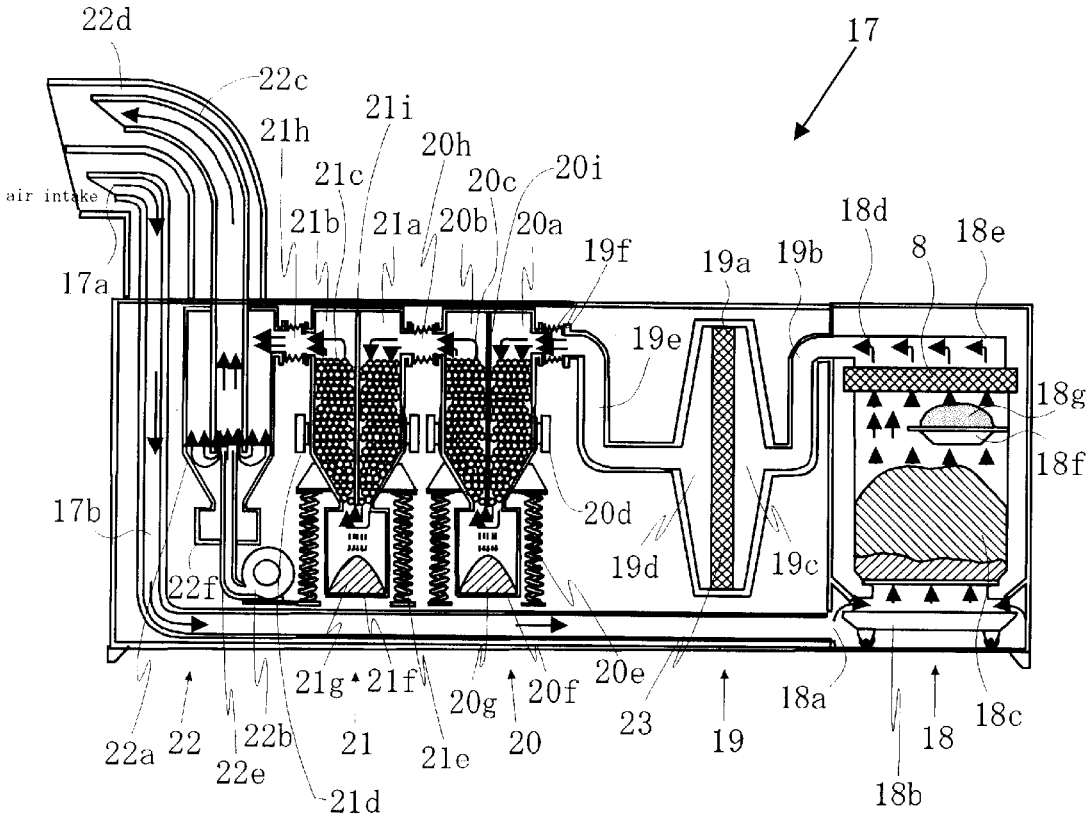
FIG. 18 is a longitudinal cross-sectional view showing another embodiment of the incinerator with a ceramics filter according to the present invention.
Figure 19:
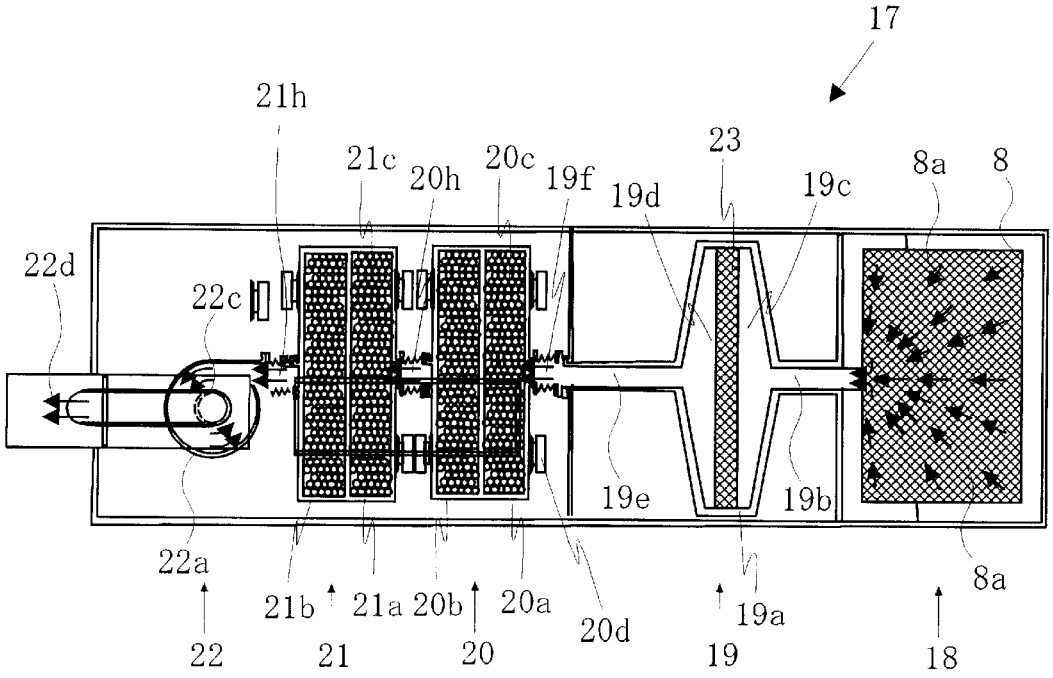
FIG. 19 is a transverse cross-sectional view showing another embodiment of the incinerator with a ceramics filter according to the present invention.

FIG. 18 is a longitudinal cross-sectional view showing another embodiment of the incinerator with a ceramics filter according to the present invention, and FIG. 19 is a transverse cross-sectional view of the incinerator with a ceramics filter according to the present invention.

As shown in FIGS. 18 and 19, the incinerator with a ceramics filter 17 of this example is constituted by: a combustion portion 18 which accessibly provides an ashpan 18*b* in an ash receiving chamber, sets an oast 18*f* for dehydrating an object to be dried 18*g* and provides a tabular ceramics filter 8 having pores 8*a* formed thereto horizontally set above the oast 18*f*; a filter portion consisting of a first filter 19 which is a tabular ceramics filter 23 vertically accommodated and set in a installation container 19*a*, a second filter 20 accommodating therein a plurality of spherical ceramics filter 20*c* and a third filter 21 accommodating therein a plurality of spherical ceramics filter 21*c*; and a suction portion 22.

The incinerator with a ceramics filter 17 of this example has a structure such that smoke, combustion hot air and the like are filtered in four stages, i.e., the tabular ceramics filter 8 whose filter is horizontally set in the combustion portion 18, the vertical set first ceramics filter 19 which is the tabular ceramics filter 23, the second filter 20 accommodating therein the spherical ceramics filters 20*c* and the third filter 21 accommodating therein the spherical ceramics filters 21*c*. This structure can completely remove dioxin which is a harmful substance contained in smoke, combustion hot air and the like.

The combustion portion 18 consists of: a bent intake pipe 17*b* having an air intake 17*a* for taking in air; a combustion chamber 18*e* to which an oast 18*f* for dehydrating an object to be dried 18*g* containing a large amount of water is attached; a pan 18*b* for receiving incinerated ash; and a tabular ceramics filter 8 for screening combustion smoke in the molecule level. The intake pipe 17*b* having the air intake 17*a* for taking in outside air is connected to the ash receiving chamber in which an ashpan 13*b* is set through the side portion of a cyclone 22*a* of a suction portion 22 and the lower portions of the first filter 19, the second filter 20 and the third filter 21.

As shown in FIGS. 18 and 19, the tabular ceramics filter 23 is vertically set in the installation container 19*a* in the first filter 19. There are a right chamber 19*c* and a left chamber 19*d* on the right and left sides of the tabular ceramics filter 23, respectively.

Reference numeral 19*b* denotes a right connection tube, and 19*e*, a left connection tube. Both the second filter 20 and the third filter 21 are hollow cylinders, and the lower portion of each filter has a cone-like shape.

There are partitions 20*i* and 21*i* in the second filter 20 and the third filter 21 in order to divide into right filter chambers 20*a* and 21*a* and left filter chambers 20*b* and 21*b*. A plurality of ball-like spherical ceramics filters 20*c* and 21*b* are accommodated in the right filter chambers 20*a* and 21*a* and the left filter chambers 20*b* and 21*b*.

The right connection tube 19*b* and the left connection tube 19*e* are connected to the installation container 19*a* of the first filter 19 in which the tabular ceramics filter 23 is housed, and the right connection tube 19*b* is connected to the combustion portion 8 while the left connection tube 19*e* is connected to the second filter 20. Springs 20*e* and 21*e* are provided under the second filter 20 and the third filter 21 so as to support these filters, and storage boxes 20*f* and 21*f* for accommodating therein filtered materials 20*g* and 21*g* which are harmful substances (dioxin) filtered by the second filter 20 and the third filter 21 are provided under the second filter 20 and the third filter 21.

The suction portion 22 consists of a cyclone 22*a*; a blower 22*b* having an air duct 22*e*; an air duct 22*e* inserted and attached in the cyclone 22*a*; and an outlet 22*d*. Smoke, combustion hot air and the like generated in the combustion portion 18 pass through the tabular ceramics filter 8 horizontally set in the combustion chamber 18*e*. They further pass through the right connection tube 19*b*, the first filter 19 to which the tabular ceramics filter 23 is attached; the left connection tube 19*e*, the inside of the connection portion. 19*f* having a cooling chamber for cooling down, the second filter 20, the connection portion 20*h*, the third filter 21, and the inside of the connection portion 21*h* having a cooling chamber for cooling down and then enter the cyclone 22*a*.

Thereafter, as to smoke, combustion hot air and the like which have entered the cyclone 22*a* through the connection portion 21*h*, the smoke, combustion hot air and the like discharged from the air duct 22*e* and filtered to contain no harmful substance such as dioxin are emitted from the outlet 22*d*.

In this manner, the smoke, combustion hot air and the like are discharged through the combustion portion 18, the first filter 19, the second filter 20, the third filter 21, the cyclone 22*a* and the exhaust duct 22*c* in the mentioned order because the air duct 22*e* attached to the blower 22*b* is inserted to the lower end of the exhaust duct 22*c* set in the cyclone 22*a*.

Since the air stream is sent from the end of the air duct 22*e* into the exhaust duct 22*c* through the lower end of the exhaust duct 22*c* by drive of the blower 22*b*, a vacuum is entirely formed in the cyclone 22*a*. Thus, the smoke, combustion hot air and the like in the combustion chamber 18, the first filter 19, the second filter 20 and the third filter 21 flow into the cyclone 16*a* so as to be sucked.

Figure 25:
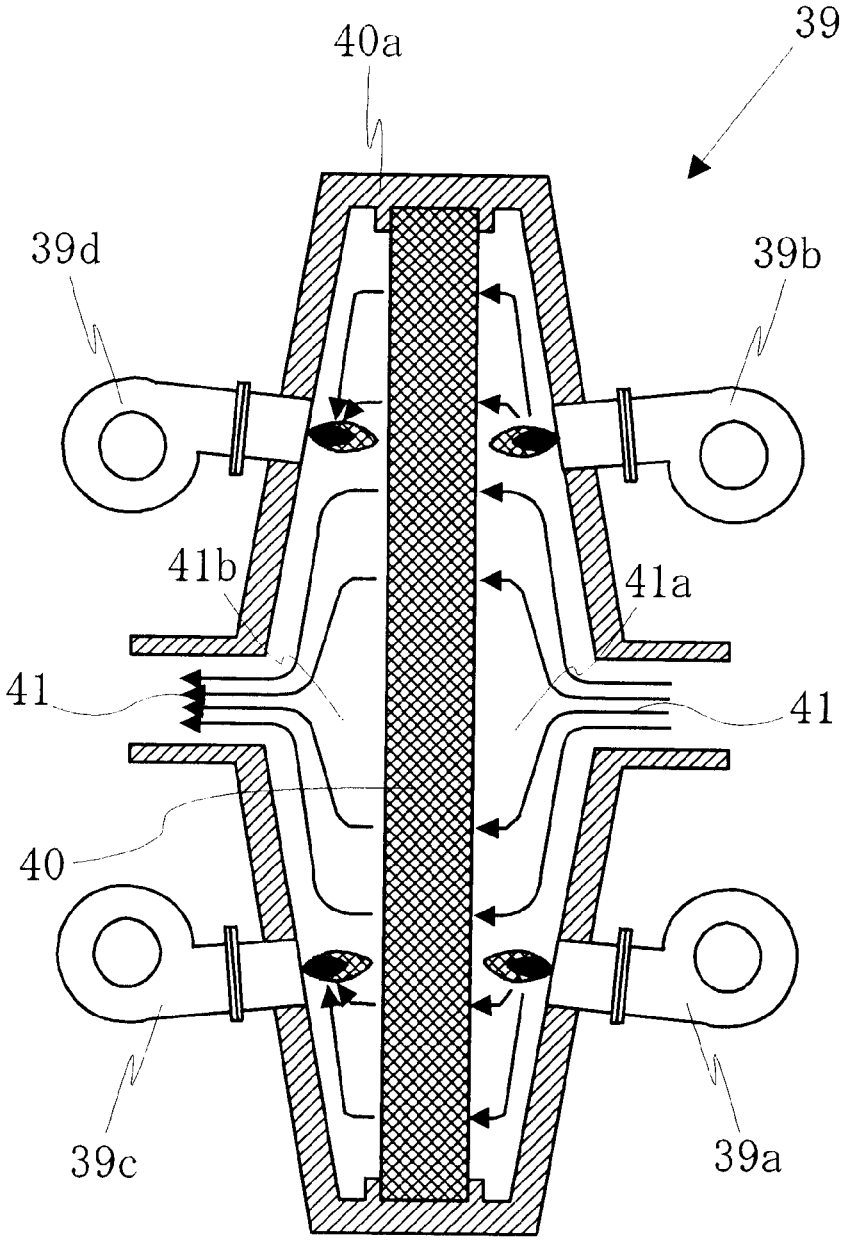
FIG. 25 is a longitudinal cross-sectional view showing the state where a tabular ceramics filter is vertically attached to the incinerator with a ceramics filter according to the present invention.
Figure 26:
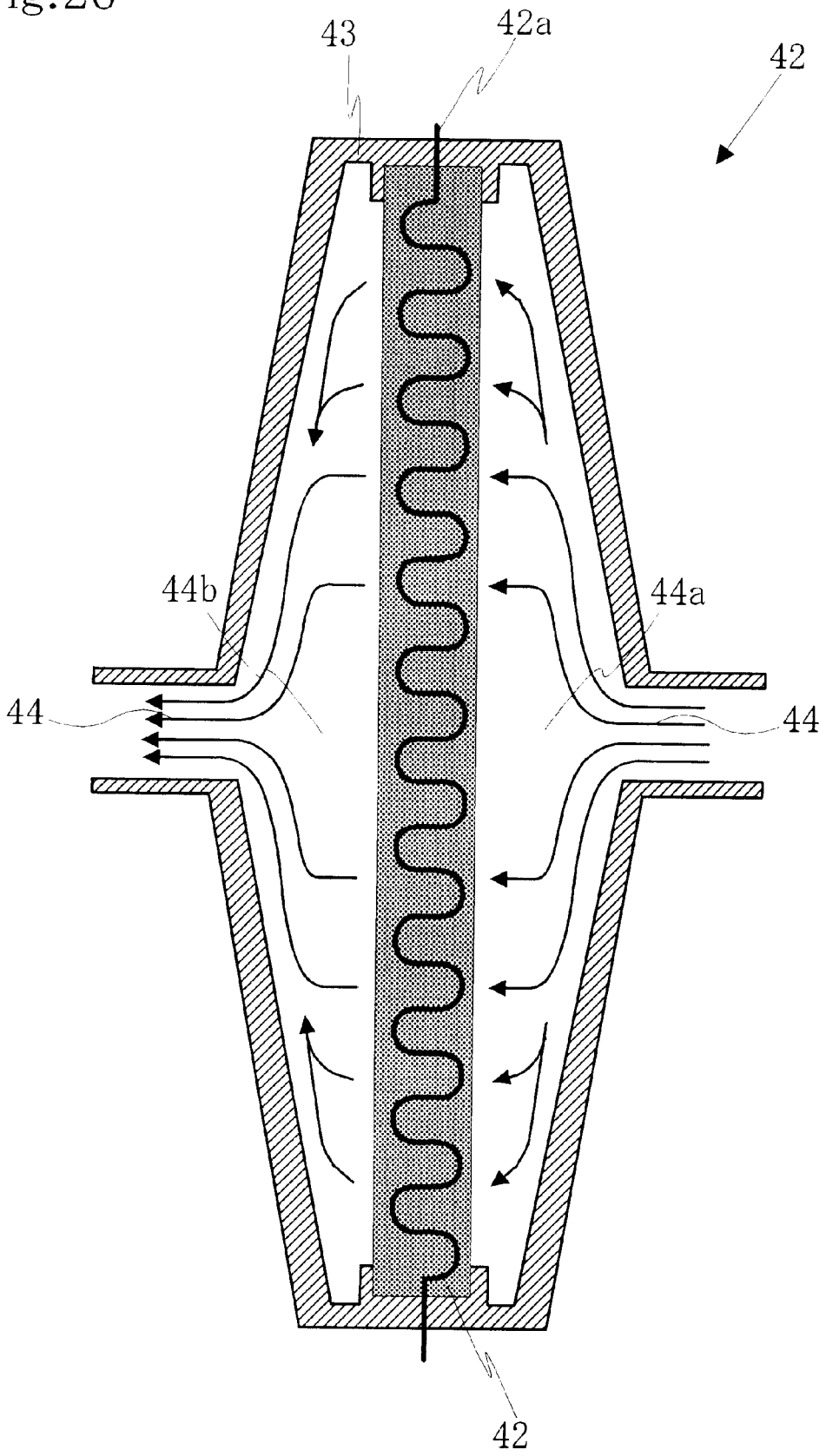
FIG. 26 is a longitudinal cross-sectional view showing the state where a tabular ceramics filter having a heater embedded therein is attached to the incinerator with a ceramics filter according to the present invention.

FIGS. 20 to 24 and FIG. 27 are longitudinal cross-sectional view showing different shapes of the ceramics filter set in the combustion portion of the incinerator with a ceramics filter according to the present invention. Further, FIGS. 25 and 26 are longitudinal cross-sectional views showing the structure of a ceramics filter in cases where the tabular ceramics filter is vertically set. Furthermore, FIGS. 28 to 32 are longitudinal cross-sectional views showing the structure where any other ceramics filter is attached in the combustion portion.

Figure 20:
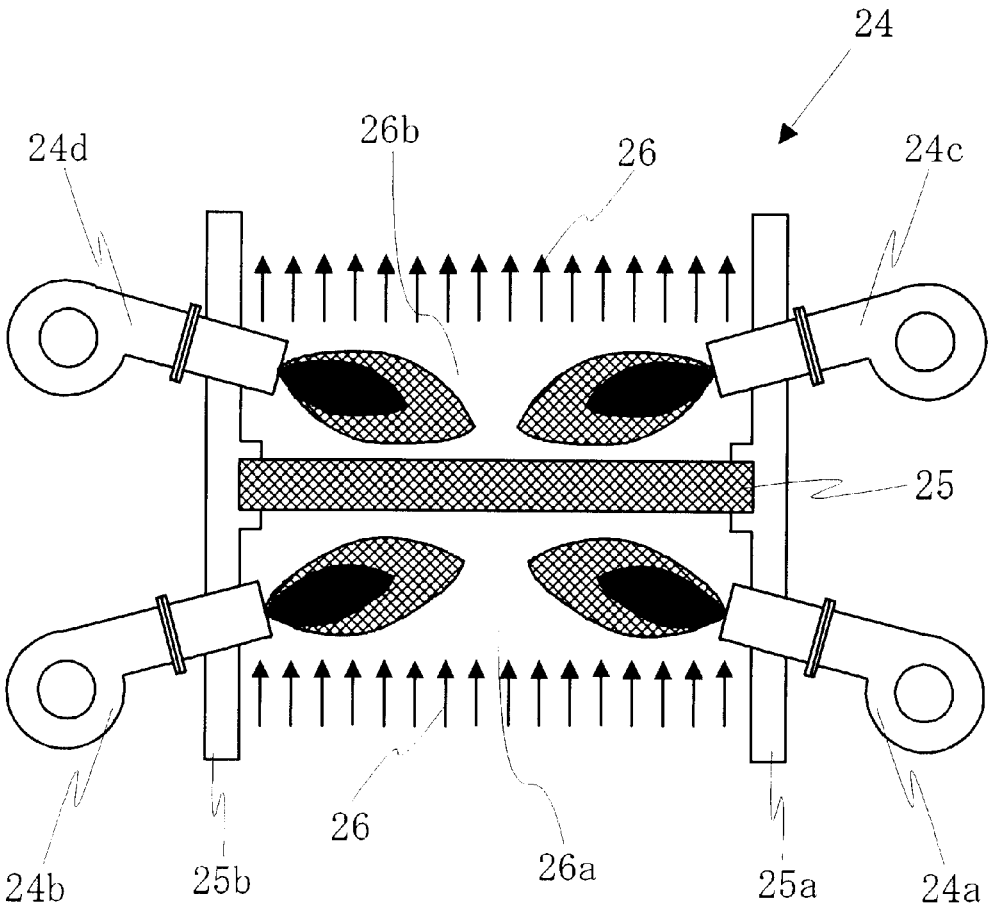
FIG. 20 is a longitudinal cross-sectional view showing the state where a tabular ceramics filter is attached to the incinerator with a ceramics filter according to the present invention.

FIG. 20 is a longitudinal cross-sectional view showing the state where the tabular ceramics filter is attached in the combustion portion of the incinerator with a ceramics filter according to the present invention. Burners 24*c* and 24*d* are set at two positions in an upper portion 26*b* of a tabular ceramics filter 25 disposed between a right furnace wall 25*a* and a left furnace wall 25*b* in a furnace, and burners 24*a* and 24*b* are also provided at two positions in a lower portion 26*a* of the tabular ceramics filter 25.

The respective burners 24*a*, 24*b*, 24*c* and 24*d* are attached on the right furnace wall 25*a* and the left furnace wall 25*b*. Although the burners are set at four positions in the lower portion 26*a* and the upper portion 26*b* of the tabular ceramics filter 25 disposed to the incinerator with a ceramics filter 24 in this example, it is possible to adopt a structure such that a burner is provided at any one position.

In addition, burners may be provided at any two position. Reference numeral 26 denotes a flow of air. Moreover, burners may be provided at any three positions. By adopting the structure where the burners are provided in this manner, when an unburned material is clogged in the fine pores formed to the tabular ceramics filter 25, that unburned material can be removed.

Figure 21:
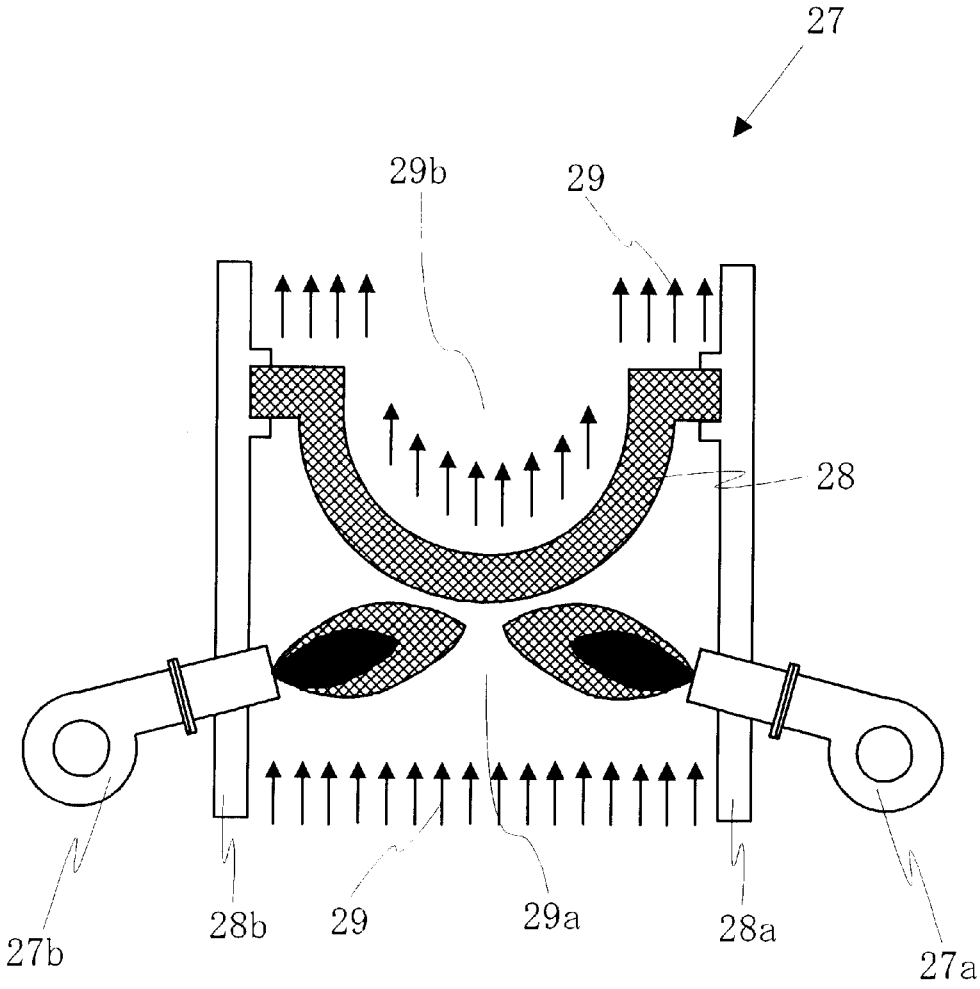
FIG. 21 is a longitudinal cross-sectional view showing the state where a pan-like ceramics filter is attached to the incinerator with a ceramics filter according to the present invention.

FIG. 21 is a view showing the state where a pan-like ceramics filter having a pan-like cross section is attached in the combustion portion of the incinerator with a ceramics filter according to the present invention. As shown in FIG. 21, in an incinerator with a ceramics filter according to the present invention, a pan-like ceramics filter 28 is employed as a ceramics filter provided in the combustion portion. The pan-like ceramics filter 28 is provided between a right furnace wall 28*a* and a left furnace wall 28*b* in the furnace. In this example, burners 27*a* and 27*b* are set at two positions in a lower portion 29*a* of the pan-like ceramics filter. The burners 24*c* and 24*d* are attached to the right furnace wall 28*a* and the left furnace wall 28*b*. It is needless to say that the burners 24*c* and 24*d* do not have to be set at two position and a burner may be provided at one position.

Figure 22:
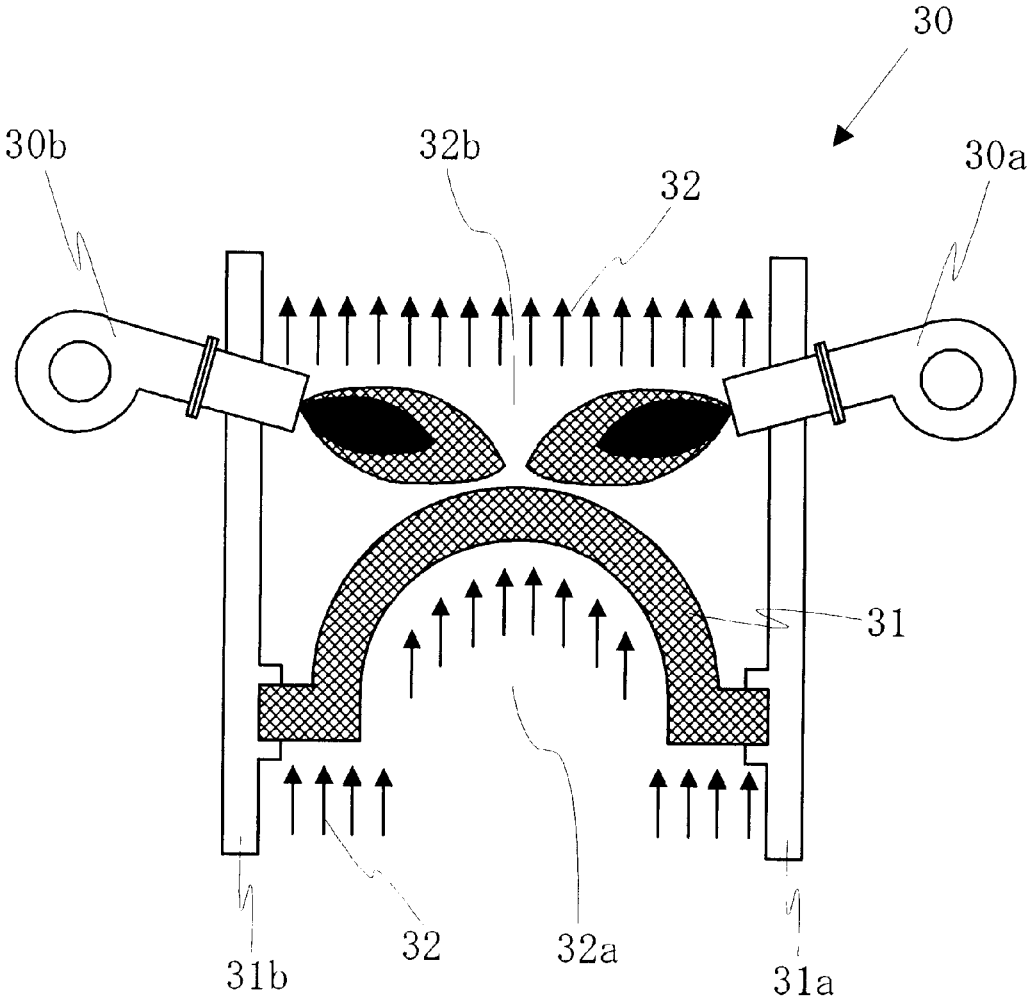
FIG. 22 is a longitudinal cross-sectional view showing a cap-like ceramics filter is attached to the incinerator with a ceramics filter according to the present invention.

FIG. 22 is a vertical cross-sectional view showing a part where a cap-like ceramics filter having a cap-like cross section is provided in the combustion portion of the incinerator with a ceramics filter according to the present invention. In this example, a ceramics filter 30 corresponds to a cap-like ceramics filter 31 having a cap-like cross section. Burners 30*a* and 30*b* are set in an upper portion 32*b* of the cap-like ceramics filter 31, and the burners 30*a* and 30*b* are provided at two position with their ends facing downwards. In this example, no burner is provided to the lower portion 32*a* of the cap-like ceramics filter 31. The cap-like ceramics filter 31 is set between the right furnace wall 31*a* and the left furnace wall 31*b* in the furnace.

The burners 30*a* and 30*b* are provided on the right furnace wall 31*a* and the left furnace wall 31*b*. Of course, the burner may be provided only at one position. Reference numeral 32 indicates a flow of air, and air passes through the cap-like ceramics filter 31 from the lower portion 32*a* of the cap-like ceramics filter 31 and flows to the upper portion 32*b* of the cap-like ceramics filter 31.

Figure 23:
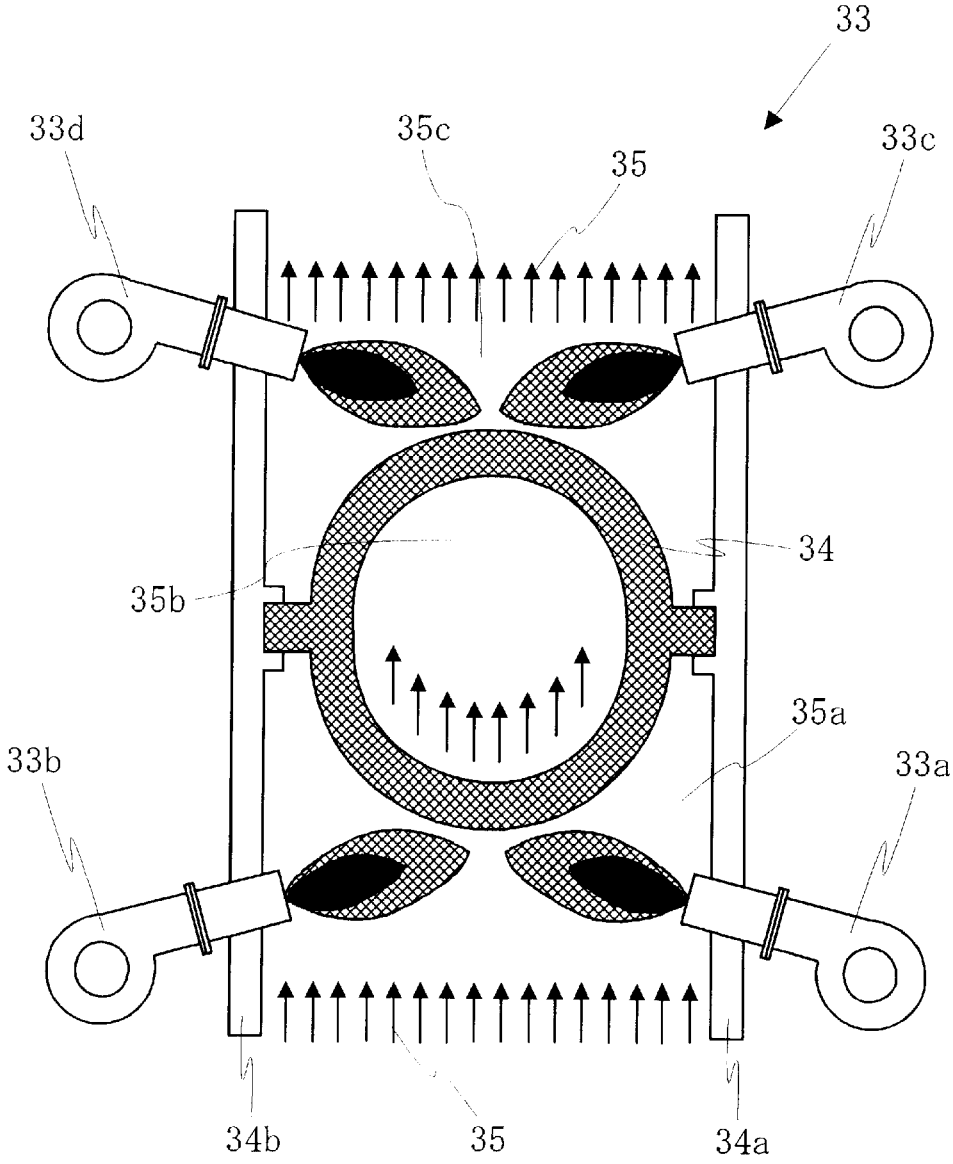
FIG. 23 is a longitudinal cross-sectional view showing the state where a hollow spherical ceramics filter is attached to the incinerator with a ceramics filter according to the present invention.

FIG. 23 is a longitudinal cross-sectional view showing the structure such that spherical hollow ceramics filter is provided in the combustion portion of the incinerator with a ceramics filter. As shown in FIG. 23, as to the ceramics filter 33 of this example, the ceramics filter 33 set in the combustion chamber corresponds to a spherical ceramics filter 34 having a hollow portion 35*b*. The spherical hollow ceramics filter 33 is provided between the right furnace wall 34*a* and the left furnace wall 34*b* in the furnace.

Burners 33*a* and 33*b* are provided to a lower portion 35*a* of the spherical ceramics filter 34 having the hollow portion 35*b* in the right-and-left direction, and burners 33*c* and 33*d* are also provided to an upper portion 35*c* of the spherical hollow ceramics filter 34 in the right-and-left direction. The burners 33*a*, 33*b*, 33*c* and 33*d* are disposed on the right furnace wall 34*a* and the left furnace wall 34*b*. Although the burners 33*a*, 33*b*, 33*c* and 33*d* are provided at four positions, the burner may be provided at only one position. Further, the burners may be provided at only two positions or three positions. Reference numeral 35 denotes a flow of air.

Figure 24:
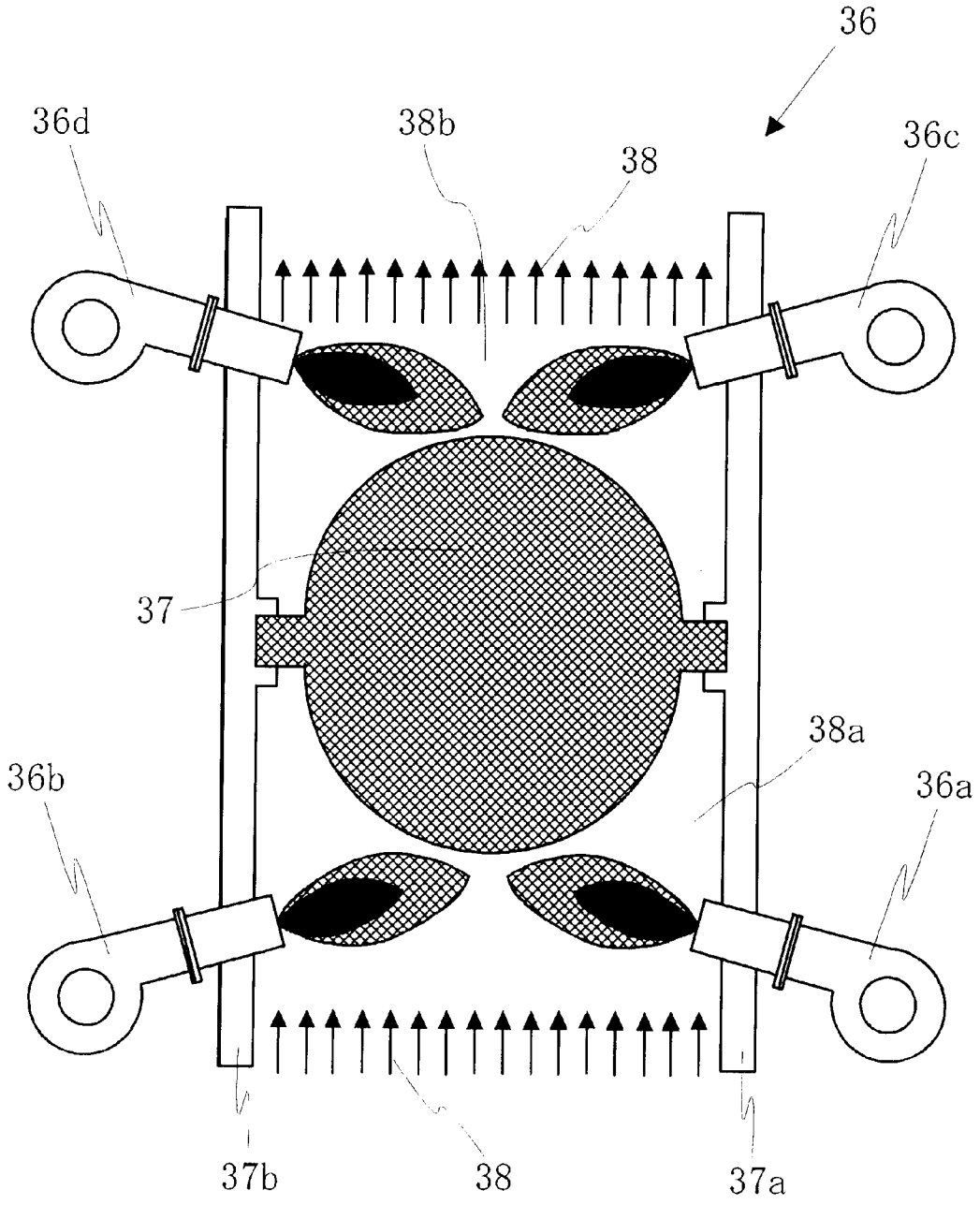
FIG. 24 is a longitudinal cross-sectional view showing the state where a spherical ceramics filter is attached to the incinerator with a ceramics filter according to the present invention.

FIG. 24 is a longitudinal cross-sectional view showing the structure where the ceramics filter attached to the incinerator with a ceramics filter according to the present invention has a spherical ceramics filter having no hollow portion provided in the combustion portion. As shown in FIG. 24, as to the ceramics filter 36 of this example, the ceramics filter 36 set in the combustion portion corresponds to the spherical ceramics filter 37 having no hollow portion therein. The spherical ceramics filter 37 having no hollow portion is set between a right furnace wall 37*a* and a left furnace wall 37*b* in the furnace.

Burners 36*a* and 36*b* are provided to a lower portion 38*a* of the spherical no hollow spherical ceramics filter 37 in the right-and-left direction, and burners 36*c* and 36*d* are also provided to an upper portion 38*b* of the spherical ceramics filter 37 in the right-and-left direction. The respective burners 36*a*, 36*b*, 36*c* and 36*d* are disposed to the right furnace wall 37*a* and the left furnace wall 37*b*. Although the burners 36*a*, 36*b*, 36*c* and 36*d* are provided at four position, the burner may be provided at only one position. Further, the burners may be provided only at two positions or three position. Reference numeral 38 denotes a direction of an air flow.

FIG. 25 is a longitudinal cross-sectional view showing the state where a tabular ceramics filter as a ceramics filter disposed to the incinerator with a ceramics filter is vertical set. In the ceramics filter 39 according to the present invention, a tabular ceramics filter 40 is vertically set in an installation container 40*a*, and four burners 39*a*, 39*b*, 39*c* and 39*d* are set at symmetrical positions with the tabular ceramics filter 40 in the center. The ceramics filter 39 of this example is set as shown in the longitudinal cross-sectional view of FIG. 18.

Reference numeral 41 designates a flow of air. The air flows from a right chamber 41*a* and a left chamber 41*b* formed on the right and left sides of the vertically set tabular ceramics filter 40 toward the left and right surfaces of the tabular ceramics filter 40. In this manner, clogging can be prevented by heating the tabular ceramics filter 40 from the both right and left surfaces by the burners 39*a*, 39*b*, 39*c* and 39*d*.

FIG. 26 is a longitudinal cross-sectional view showing the state where a tabular ceramics filter having a heater embedded therein is vertically set in the incinerator with a ceramics filter according to the present invention. In the incinerator with a ceramics filter such that the tabular ceramics filter 42 having a heater 42*a* embedded therein is provided, the tabular ceramics filter 42 having a heater 42*a* embedded therein is vertically set in an installation container 43. The tabular ceramics filter 42 of this example is provided as shown in the longitudinal cross-sectional view of FIG. 18.

Reference Numeral 44 denotes a flow of air. The air flows from a right chamber 44*a* and a left chamber 44*b* formed on the right and left sides of the vertically set tabular ceramics filter toward the right and left surfaces of the tabular ceramics filter 42 having the heater 42*a* embedded therein. In this manner, the tabular ceramics filter 42 itself can be prevented from being clogged by providing the heater 42*a* inside the tabular ceramics filter 42.

Figure 27:
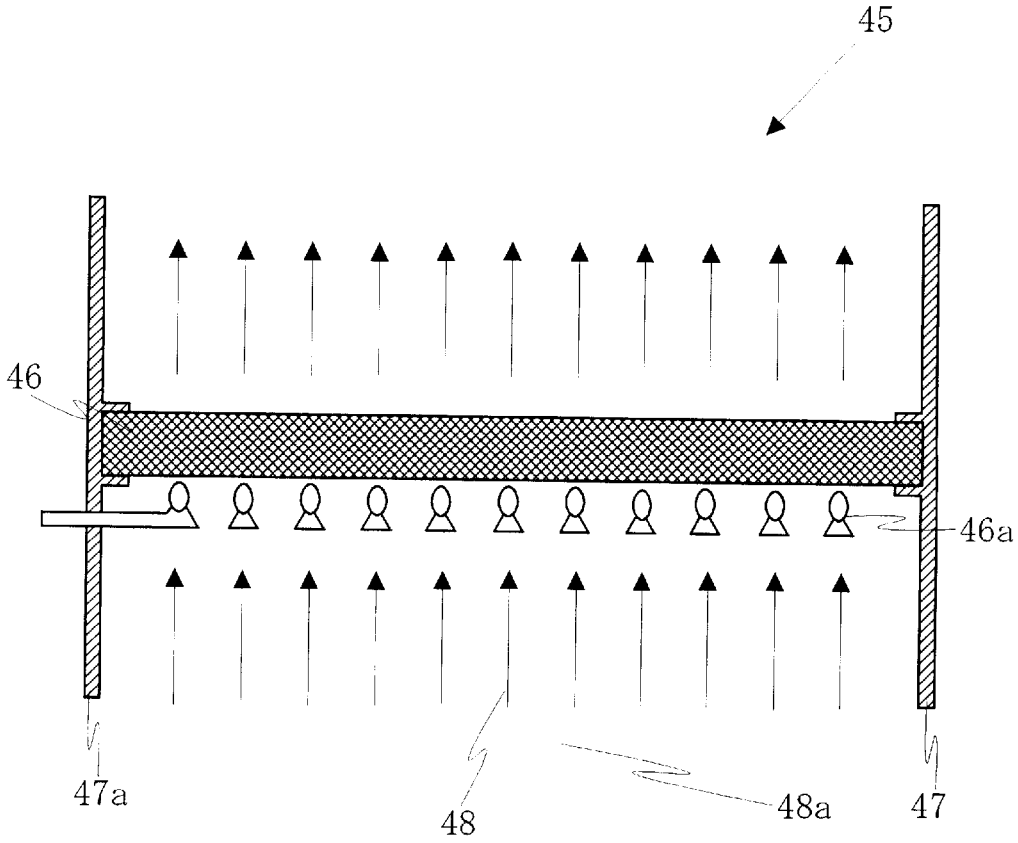
FIG. 27 is a longitudinal cross-sectional view showing the state where a tabular ceramics filter is attached to the incinerator with a ceramics filter and a stove is also provided.

FIG. 27 is a longitudinal cross-sectional view showing the state where a tabular ceramics filter is provided to the incinerator with a ceramics filter according to the present invention and heated by a stove. As shown in FIG. 27, according to the tabular ceramic filter 46 of the ceramics filter 45 in this example, a plurality of stoves 46*a* are provided to a lower portion 48*a* of the tabular ceramics filter 46 disposed to a right furnace wall 47 and a left furnace wall 47*a* so that the tabular ceramics filter 46 is heated by a plurality of the stoves 46*a*. In this manner, the tabular ceramic filter 46 can be prevented from being clogged by heating the tabular ceramics filter 46 from the lower portion 48*a*. Reference numeral 48 denotes a flow of air, and air flows from the lower portion 48*a* upwards.

Figure 28:
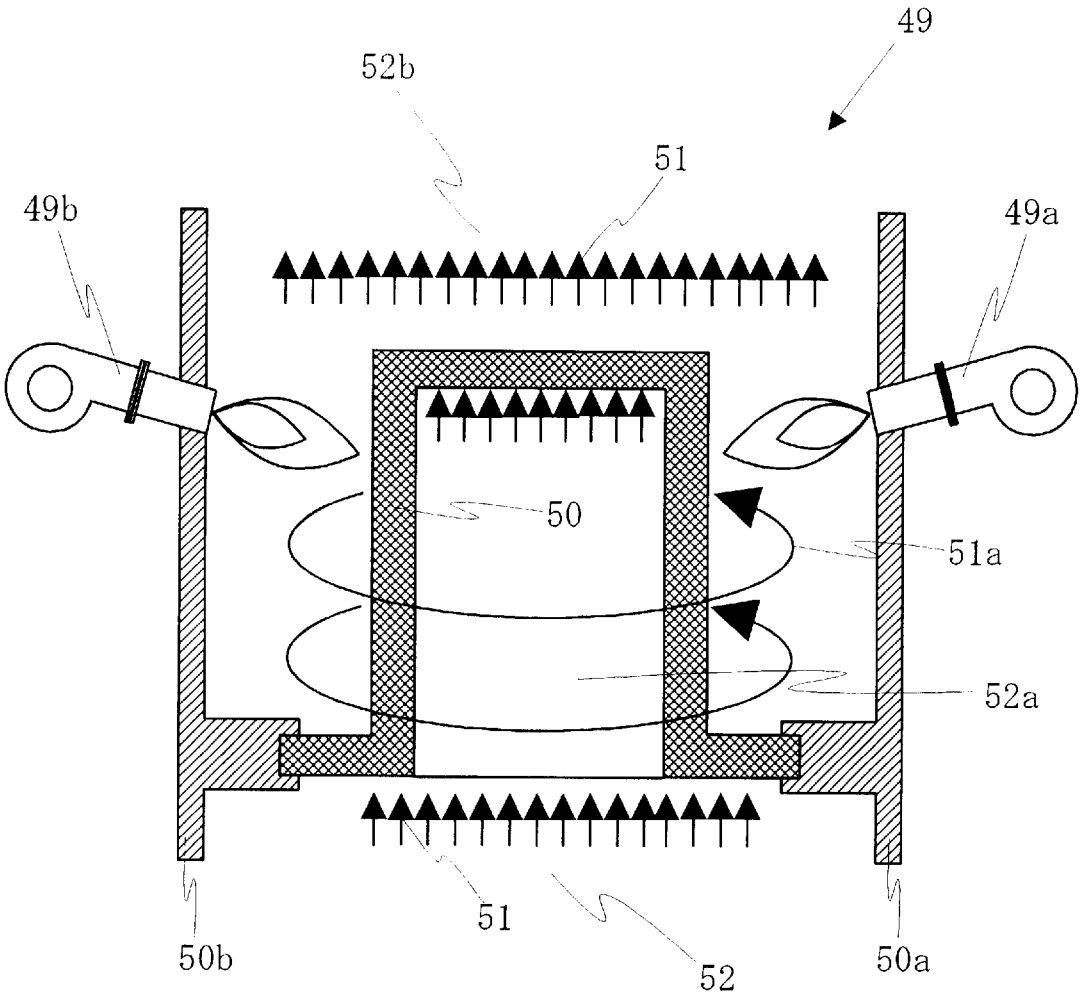
FIG. 28 is a longitudinal view showing the state where a ceramics filter having a tall-hat-like cross section is attached to the incinerator with a ceramics filter according to the present invention.

FIG. 28 is a longitudinal cross-sectional view showing the state where a ceramics filter having a tall-hat-like cross section is provided in the combustion portion of the incinerator with a ceramics filter and heated by disposed burners. In the ceramic filter 49 of this example, burners 49*a* and 49*b* are provided at two positions on the external side of the cylindrical portion of the tall-hat-like ceramics filter 50 disposed to a right furnace wall 50*a* and a left furnace wall 50*b* with ends of the burners 49*a* and 49*b* facing downwards. Further, an air flow 51*a* like a whirlpool is formed on the external side of the tall-hat-like ceramics filter 50 by power of flames from the burners 49*a* and 49*b*. The air flow 51 passes through the tall-hat-like ceramics filter 50 from the lower portion 52 to flow into the upper portion 52*b*.

Forming such an air flow 51 can remove dioxin which is a harmful substance by using the tall-hat-like ceramics filter 50. The air flow 51 passes through an inner portion 52*a* from the lower portion 52 of the tall-hat-like ceramics filter 50 to enter the upper portion 52*b*.

Figure 29:
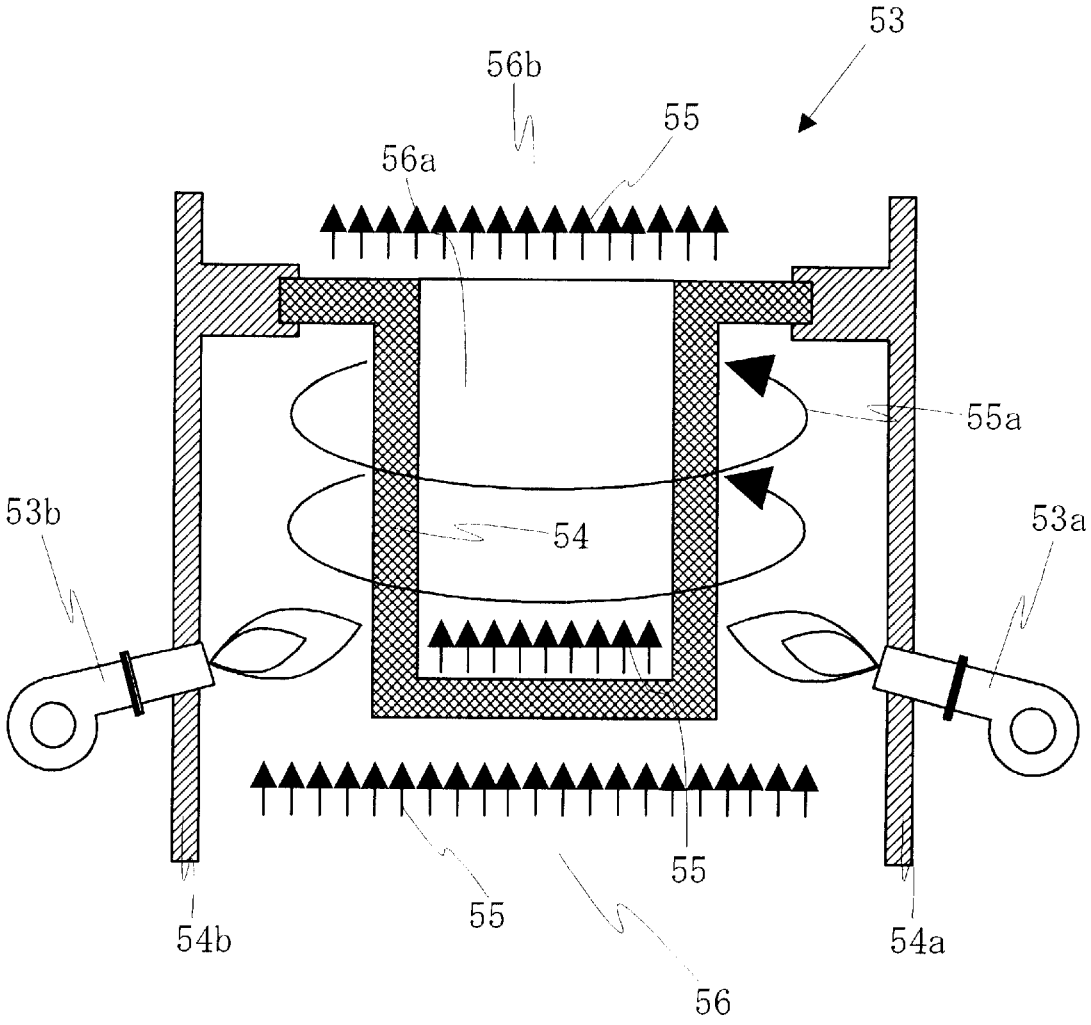
FIG. 29 is a longitudinal cross-sectional view showing the state where a ceramics filter having an inverted-tall-hat-like cross section is attached to the incinerator with a ceramics filter.

FIG. 29 is a longitudinal cross-sectional view showing the state where a ceramics filter having an inverted-tall-hat-like cross section is provided in the combustion portion of the incinerator with a ceramics filter according to the present invention.

As shown in FIG. 29, in the ceramics filter 53 of this example, burners 53*a* and 53*b* are provided on the external side of a cylindrical portion of the inverted-tall-hat-like ceramics filter 54 with ends of the burners 53*a* and 53*b* facing downwards. Further the inverted-tall-hat-like ceramics filter 54 is heated by the burners 53*a* and 53*b*.

The inverted-tall-hat-like ceramics filter 54 is fixed to a right furnace wall 54*a* and a left furnace wall 54*b*. An air flow 55*a* like a whirlpool is formed on the external side of the inverted-tall-hat-like ceramics filter 54 by power of flames from the burners 53*a* and 53*b*.

Forming the air flow 55*a* in this manner can remove dioxin which is a harmful substance by using the inverted-tall-hat-like ceramics filter 54. Reference numeral 55 denotes an air flow, and the air passes through an inner portion 56*a* from a lower portion 56 of the inverted-tall-hat-like ceramics filter 54 to flow to an upper portion 56*b*. In this way, the ceramics filter 54 can be prevented from being clogged by heating the inverted ceramics filter 54.

Figure 30:
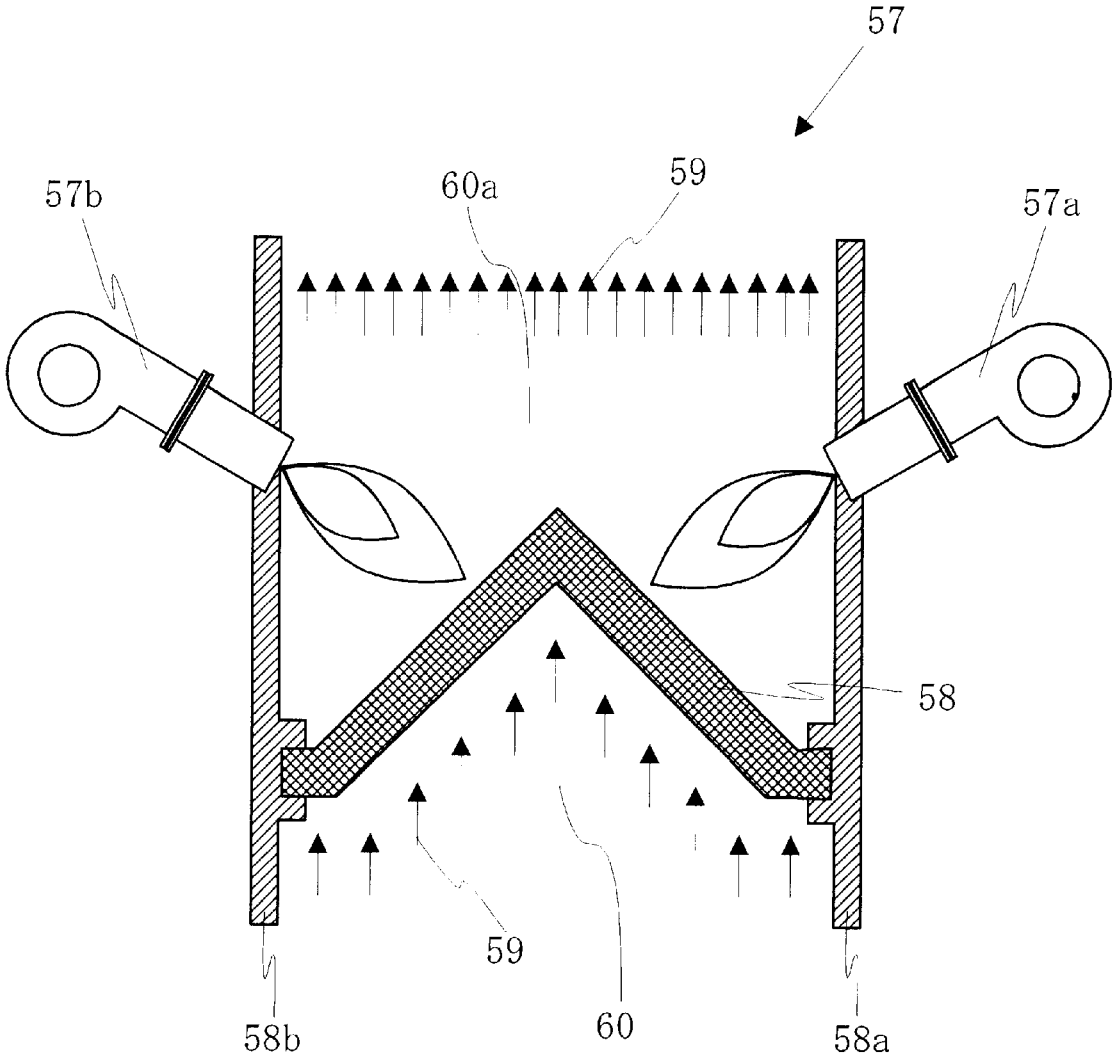
FIG. 30 is a longitudinal cross-sectional view showing the state where a ceramics filter having a triangular cross section is attached to the incinerator with a ceramics filter according to the present invention and a burner is also disposed.

FIG. 30 is a longitudinal cross-sectional view showing the state where a ceramics filter having a triangular cross section is attached to a combustion portion of the incinerator with a ceramics filter according to the present invention. In the triangular ceramics filter 58 of this example, burners 57*a* and 57*b* are attached at two position of an upper portion 60*a* of the triangular ceramics filter 58 with ends of the burners 57*a* and 57*b* being directed downwards. In case of the ceramics filter of this example, no burner is attached to a lower portion 60 of the triangular ceramics filter 58.

The burners 57*a* and 57*b* are attached to right and left furnace walls 58*a* and 58*b*. Of course, a burner may be provided at only one position. An arrow denoted by reference numeral 59 indicates a flow of air, and the air passes through the triangular ceramics filter 58 from a lower portion 60*a* of the triangular ceramics filter 58 to flow to the upper portion 60*a* of the triangular ceramics filter 58.

Figure 31:
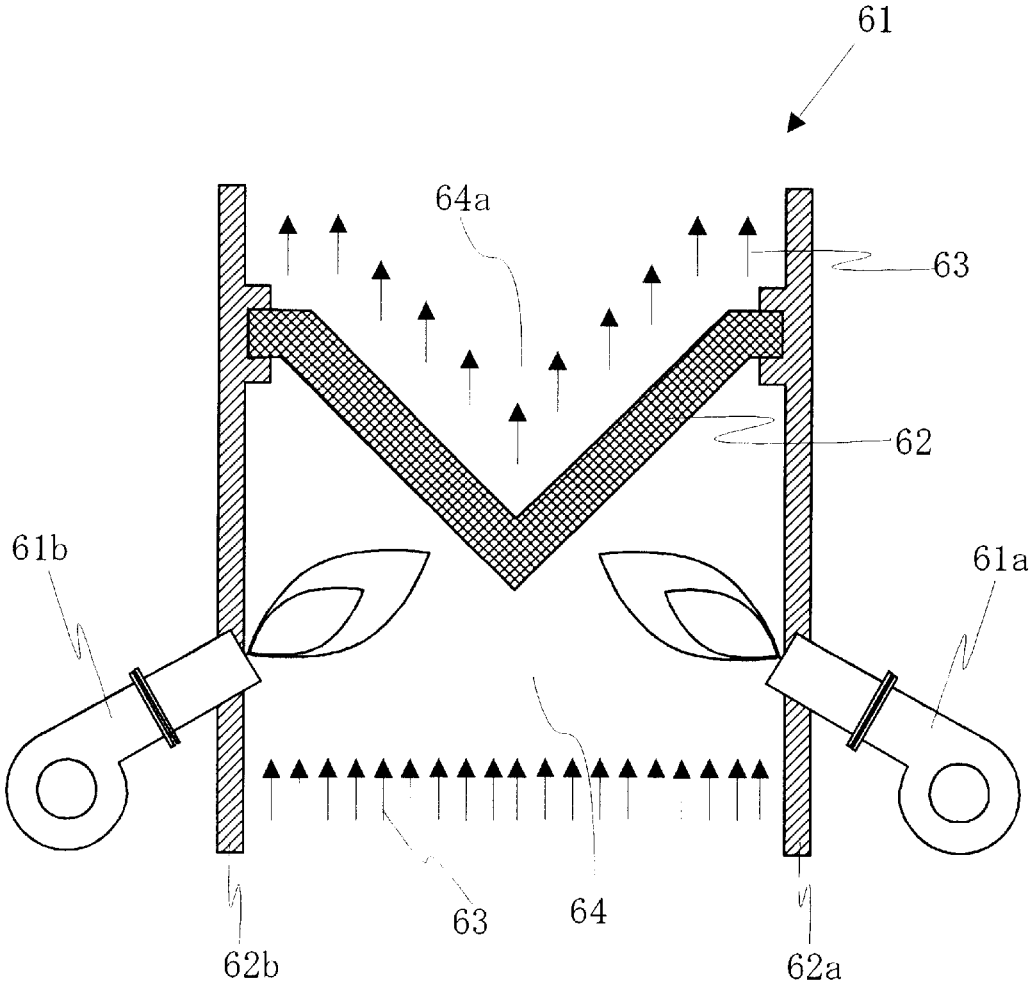
FIG. 31 is a longitudinal cross-sectional view showing the state where a ceramics filter having an inverted-triangular cross section is attached to the incinerator with a ceramics filter and a burner is also provided.

FIG. 31 is a longitudinal cross-sectional view showing the state where an inverted triangular ceramics filter is attached to the combustion portion of the incinerator with a ceramics fitter according to the present invention. In the inverted triangular ceramics filter 62 of this example, burners 61*a* and 61*b* are attached at two position of a lower portion 64 of the inverted triangular ceramics filter 62 with ends of the burners 61*a* and 61*b* being directed upwards. In case of the ceramics filter of this example, no burner is attached to an upper portion 60*a* of the inverted triangular ceramics filter 62.

The burners 61*a* and 61*b* are provided between a right furnace wall and a left furnace wall 62*b*. Of course, a burner may be provided at only one position. An arrow denoted by reference numeral 63 indicates a flow of air, and the air passes through the inverted triangular ceramics filter 62 from a lower portion 64 of the inverted triangular ceramics filter 62 to flow to an upper portion 64*a* of the inverted triangular ceramics filter 62.

Figure 32:
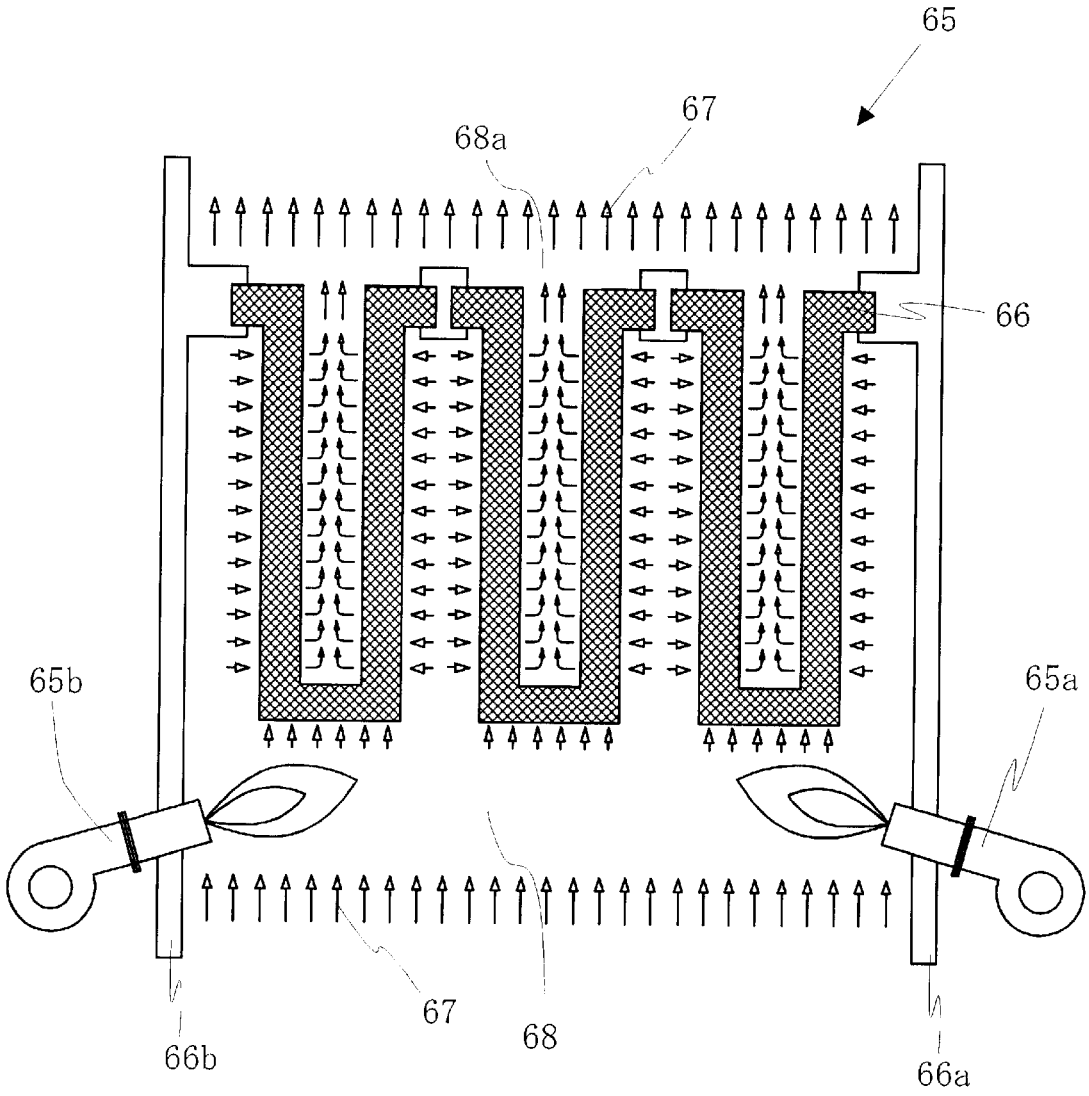
FIG. 32 is a longitudinal cross-sectional view showing the state where a continuous U-shaped ceramics filter is attached to the incinerator with a ceramics filter according to the present invention and a burner is also provided.

FIG. 32 is a longitudinal cross-sectional view showing the state where a continuous U-shaped ceramics filter is attached, the ceramics filter having a U-shaped cross section being connected to the combustion portion of the incinerator with a ceramics filter. In the continuous U-shaped ceramics filter 66 of the ceramics filter 65 in this example, burners 65*a* and 65*b* are provided at two position of a lower portion 68 of the continuous U-shaped ceramics filter with the ends of the burners 65*a* and 65*b* being directed upwards. In case of the ceramics filter of this example, no burner is attached to an upper portion 68*a* of the continuous U-shaped ceramics filter 66.

The burners 65*a* and 65*b* are provided between a right furnace wall 66*a* and a left furnace wall 66*b*. Of course, the burner may be provided at only one position. An arrow denoted by reference numeral 67 indicates a flow of air, and the air passes through the continuous U-shaped ceramics filter 66 from the lower portion 68 of the continuous U-shaped ceramics filter 66 to flow to the upper portion 68*a* of the continuous U-shaped ceramics filter 66.

FIG. 33 shows an other embodiment of the incinerator with a ceramics filter according to the present invention, which is an incinerator in which ceramics filters are set in multiple stages in the combustion portion. As shown in FIG. 33, the incinerator 69 with a ceramics filter of this example is an incinerator 69 having a structure such that respective tabular ceramics filters 71, 71*a* and 71*b* are provided on a slat at three stages, i.e., an upper portion, a center and a lower portion in a combustion portion 69*f*.

Cabinets 69*d* for accommodating therein a filtered substance 69*e* removed from smoke, combustion hot air and the like by the tabular ceramics filters 71, 71*a* and 71*b* are provided in the combustion portion 69*f*. Further, burners 70, 70*a* and 70*b* are attached to the combustion portion 69*f*. The respective burners 70, 70*a* and 70*b* are upwardly provided below the tabular ceramics filters 71, 71*a* and 71*b* set in the combustion portion 69*f* so as to face the lower surfaces of the tabular ceramics filters 71, 71*a* and 71*b*.

A fire grate 69*c* is having a vibrator 69*g* is provided to a lower portion of a combustion portion 69*f*. The vibrator 69*g* vibrates the fire grate 69*c* in such a manner that incinerated ash 69*i* remaining after burning of an object to be incinerated 69*h* does not 11*e* on the fire grate 69*c*, and the incinerated ash 69*i* on the fire grate 69*c* is caused to fall on an ashpan 69*b*. The ashpan 69*b* can be removed from or inserted into an ash receiving chamber where the ashpan is set.

Smoke, combustion hot air and the like pass through the tabular ceramics filters 71, 71*a*, 71*b* and 71*c* provided on a slat at three stages and discharged so as to be sucked from an emission port 72*a*. In this manner, when the tabular ceramics filters are respectively provided at three stages to the upper portion, an amount of dioxin discharged into the air can be greatly reduced.

FIG. 34 is a longitudinal cross-sectional view showing a cyclone with a burner attached to the combustion portion of the incinerator with a ceramics filter according to the present invention. FIG. 35 is a transverse cross-sectional view showing the cyclone with a burner attached to the combustion portion of the incinerator with a ceramics filter according to the present invention.

As shown in FIGS. 14 and 15, the incinerator with a ceramics filter according to the present invention has a structure such that an object to be incinerated is burned up and incinerated in a combustion portion and the ceramics filter is used to remove dioxin which is a harmful substance contained in smoke, combustion hot air and the like by filtration of the ceramics filter.

However, as shown in FIGS. 34 and 35, a minute amount of dioxin, an unburned material and the like may be produced even if smoke, combustion hot air and the like generated by combustion of an object to be incinerated in the combustion portion passes through the ceramics filter. Since the ceramics filter is provided, when a harmful substance, an unburned material and the like is again burned by attaching the cyclone with a burner 73 to the combustion portion, the harmful substance such as dioxin is prevented from being discharged in the air.

An object to be incinerated is burned in a combustion chamber of the combustion portion to generate a harmful substance such as dioxin, an unburned material and the like. They pass through the ceramics filter provided in the combustion portion. Then, smoke, combustion hot air and the like from which almost all the harmful substance such as dioxin, the unburned material and the like are removed passes through a connection duct 73*a* and are sucked in and flows into the cyclone with a burner 73 like an air flow 74.

Even if the smoke, combustion hot air and the like flowing into the cyclone with a burner 73 passes through the ceramics filter provided in the combustion portion to remove a harmful substance therefrom, they may contain a given harmful substance or unburned material and the like which flows into the cyclone with a burner 73 without being completely removed by the ceramics filter.

As shown in FIG. 35, the smoke, the combustion hot air and the like sucked into the cyclone with a burner rotate above a cyclone chamber 73*c* of the cyclone with a burner 73 by flames of a burner 73*e* whilst a harmful substance, an unburned material and the like contained the smoke, the combustion hot air and the like in the cyclone chamber 73*c* are again burned.

The harmful substance, the unburned material and the like which have remained 73*g* from combustion fall into cabinets 73*f* attached at a center of the cyclone chamber 73*c* to be accommodated therein. The smoke, the combustion hot air and the like from which the harmful substance, the unburned material and the like contained therein have been removed are sucked into an air duct 73*d* to be discharged into the air. In addition, the harmful substance, the unburned material and the like which do not fall into the cabinets 73*f* further falls into a dust receiver 73*h*.

As shown in FIG. 34, a blower 73*b* is provided to the lower portion of the cyclone with a burner 73, and an air duct 73*i* attached to the blower 73*b* pierces the dust receiver 73*h*, the end of the air duct 73*i* being inserted into the lower end of the air duct 73*d*.

Since the clean smoke, combustion hot air and the like whose unburned material or harmful substance 2 has been accommodated in and fallen into the cabinet 73*f* and the dust receiver 73*h* are forcibly sent from the end of the air duct 73*i*, the smoke, combustion hot air and the like from which the unburned material, the harmful substance and the like have been completely removed enter the air duct 73*d* with an air stream forcibly sent from the lower end of the air duct 73*d* and are discharged from the upper portion of the air duct 73*d* in the air.

In this manner, the smoke, combustion hot air and the like are forcibly sent from the air duct 73*i* to be emitted from the air duct 73*d*, and a vacuum is hence formed in the cyclone chamber 73*c*. As described above, since a vacuum is formed in the cyclone chamber 73*c*, the smoke, the combustion hot air and the like in the combustion portion pass through the connection duct 73*a* from the combustion portion and flow in the cyclone chamber 73*c* so as to be sucked therein.

FIG. 36 is a front view of a vacuum pump which is attached to the incinerator with a ceramics filter according to the present invention and used for suction, and FIG. 37 is a plane view of a vacuum pump which is attached to the incinerator with a ceramics filter according to the present invention to be used.

For example, in the incinerator with a ceramics filter 7 shown in FIG. 8, by taking in fresh air by suction into the combustion chamber from an air intake 7*a* which is formed to the combustion portion by directly being attached to the upper portion of the combustion portion, an object to be incinerated can be completely burned up.

In the incinerator with a ceramics filter 9 shown in FIG. 10, fresh air can be sucked from an ash receiving chamber which is attached to a suction portion 9*f* of the combustion portion and has an ashpan 9*c* set therein so that an object to be incinerated 9*d* can be completely incinerated.

In the incinerator with a ceramics filter having a suction portion, a cyclone and the like as shown in FIGS. 12, 14, 16 and 18, a vacuum pump 75 is attached to the suction portion or the cyclone to forcibly suck smoke, combustion hot air and the like in the combustion portion, and fresh air can be hence taken into the combustion portion from the lower portion of the combustion portion.

As shown in FIGS. 36 and 37, in the vacuum pump 75, a moving vane is constituted by a pump main body 75*a*, an opening/closing portion 75*b*, a suction port 75*c* and an outlet 75*d*. In the vacuum pump 75, a rotating fan is rotated by drive of a motor.

FIG. 38 is a longitudinal cross-sectional view of a cyclone attached to a ceramics filter according to the present invention. This is a longitudinal cross-sectional view showing the cyclone 76 adopting the ejector suction system. As shown in FIG. 38, the cyclone 76 such as shown in FIG. 38 can be attached to the incinerator with a ceramics filter. The cyclone 76 has a structure such that an exhaust tube 76*d* is attached to a cyclone chamber 76*a* so as to protrude therefrom and a air duct 76*g* of a blower 76*c* is provided at the lower end of the exhaust tube, and the air burned by the combustion chamber is sucked into the cyclone chamber 76*a* from a suction port 76*b* of the cyclone 76. Reference numeral 76*h* denotes a dust receiver for receiving an unburned material which falls in the cyclone chamber 76*a*.

At this time, when the blower 76*c* is driven, since an air stream is forcibly sent from the end of the air duct 76*g* into the exhaust tube 76*d*, the air in the cyclone chamber 76*a* is forcibly sucked into the exhaust tube 76*d*. Therefore, the air pressure in the cyclone chamber 76*a* is reduced. In this manner, the air in the cyclone chamber 76*a* is sucked into the exhaust tube 76*d* (the ejector effect), and the smoke, the combustion hot air and the like generated in the combustion chamber and sucked from the suction port 76*b* pass through the exhaust tube 76*d* to be emitted into the air. The flow of air 76*e* is sucked from the suction port 76*b* to become a billowing air flow 76*f* around the exhaust tube 76*d*. Thereafter, this air flow moves down to be sent from the air duct 76*g* from the lower end of the exhaust tube 76*d* and passes through the exhaust tube 76*d* to be discharged into the air together with an air stream.

Figure 39:
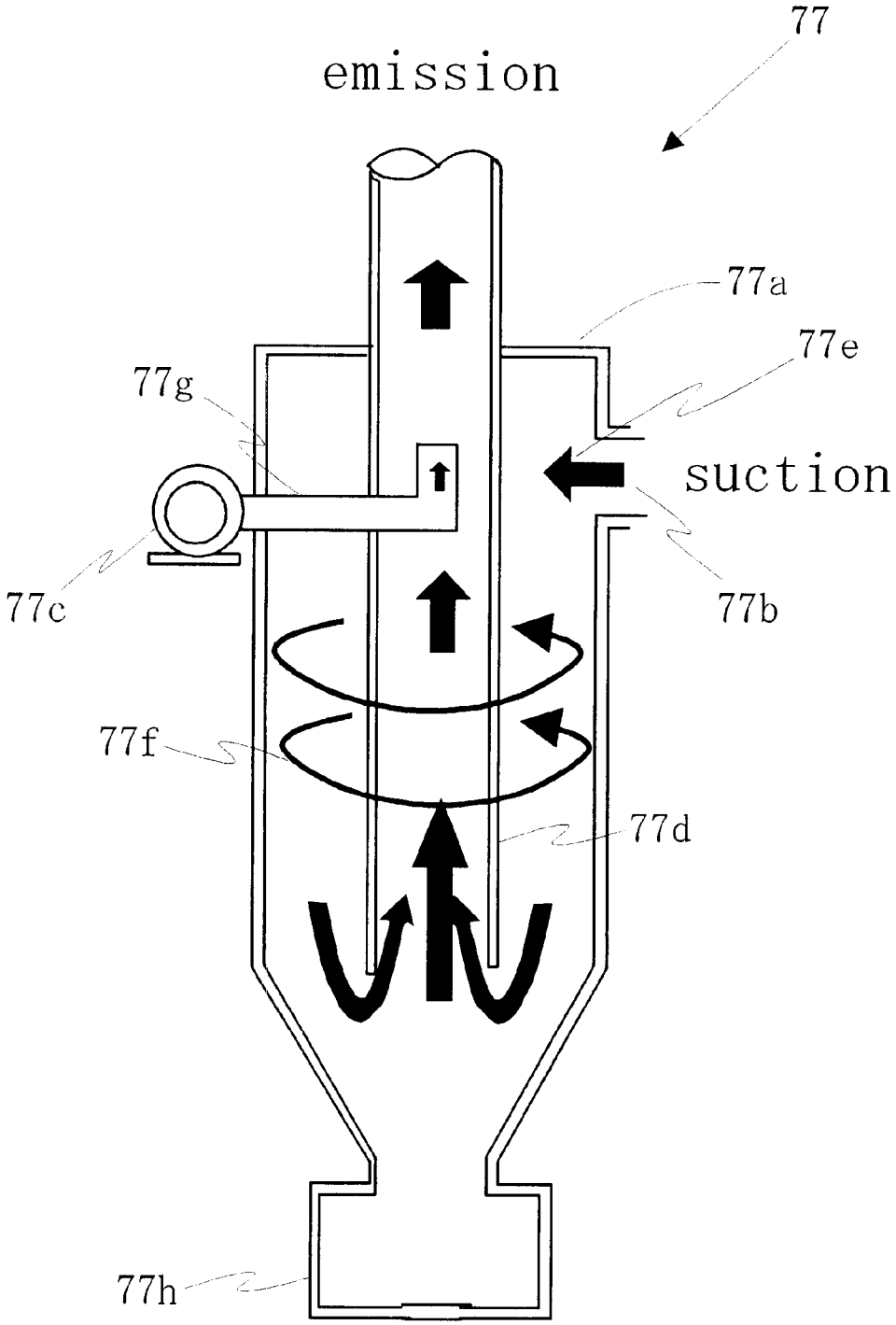
FIG. 39 is a view showing another embodiment of the cyclone attached to the incinerator with a ceramics filter according to the present invention to be used.

FIG. 39 is a view showing another embodiment of the cyclone attached to the incinerator with a ceramics filter according to the present invention. In a cyclone 77 of this example, a blower 77*c* having an air duct 77*g* is provided to the upper portion of a cyclone chamber 77*a*, and the end of an air duct 77*g* of the blower 77*c* is inserted into an exhaust tube 77*d*. Any other structure is the same as that of the cyclone shown in FIG. 38.

A catalytic filter utilizing a catalyst capable of removing a harmful substance such as dioxin may be provided instead of the ceramics filter attached to the incinerator with a ceramics filter according to the present invention. Specifically, the catalytic filter may substitute for the tabular ceramics filter 8 shown in FIG. 8, the tabular ceramics filter 8 shown in FIG. 10, the tabular ceramics filter 8 depicted in FIG. 12, the tabular ceramics filter 8 illustrated in FIG. 14, the tabular ceramics filter 8 shown in FIG. 16, the tabular ceramics filter 8 and the vertically set tabular ceramics filter 23 illustrated in FIG. 18.

Here, as the catalyst used for the catalytic filter, there are a precious metal catalyst and an oxidation catalyst. As a catalytic component, it is known that the precious metal catalyst has the highest activity and is a most likely candidate for a catalyst which clarifies the exhaust gas in the incinerator. The precious metal catalyst is a catalyst obtained by titanium oxide is caused to adhere honeycomb-shaped or fibrous ceramic and platinum and the like is studded. It is reported that, among many precious metal catalysts, "the Pt/Ti102 catalyst" demonstrates the degradation effect of not less than 99 percent in the dioxin degradation test under the condition of SV=not more than 3000 $h^{-1}$ and 250 to 300° C.

As to the oxidation catalyst used as a catalyst, the oxidation catalyst is obtained by dispersing as fine particles a catalyst component of approximately 100 A on the surface of a ceramic component having a high superficial area over 100 $m^2/g$ which is called a wash coat. It is applied on a structure called the honeycomb or foam and used as a catalyst. In this manner, the fine-grained catalyst with the high dispersibility has the surface with special solid state properties so that dioxin having an organic component can be degraded when the catalyst surface has a temperature lowered by 250° C.

A vibrator for vibrating the tabular ceramics filter 8 may be provided to the tabular ceramic filter 8 attached to the incinerator with a ceramics filter according to the present invention so that the ceramics filter 8 is vibrated. With such a structure, the ceramics filter can be prevented from being clogged.

POSSIBILITY OF INDUSTRIAL UTILIZATION

Since the present invention has the above-described structure, the following advantages can be obtained.

At first, using the ceramics filter can completely remove dioxin which is a harmful substance and also remove an unburned material.

At second, taking a usage after incineration or an incineration time into consideration, it is possible to select an appropriate process to perform disposal without producing harmful substances.

What is claimed is:

1. An incinerator with a ceramics filter, wherein air intakes to which a check valve is provided are formed on right and left lower portions of said incinerator and an oast is set in a combustion chamber, a tabular ceramics filter for removing harmful substances being attached to an upper portion of said oast, and a suction port being disposed in an upper portion of said tabular ceramics filter.

2. An incinerator with a ceramics filter, wherein an air intake to which a check valve is provided is formed to a lower portion of said incinerator and an ashpan is accessibly set, an cast being set in a combustion chamber, a tabular ceramics filter for removing harmful substances being attached to an upper portion of said cast, a suction port being formed to an upper portion of said tabular ceramics filter.

3. An incinerator with a ceramics filter, wherein an ashpan is accessibly set to a lower portion of a combustion portion and an cast is set in a combustion chamber, a tabular ceramics filter for removing harmful substances being attached to an upper portion of said oast, a cyclone which inserts an end of an air duct of a blower to a lower edge of an exhaust duct attached to said cyclone and has a dust receiver being attached to said incinerator having a suction port formed thereto above said tabular ceramics filter.

4. An incinerator with a ceramics filter, wherein an intake pipe bent under a combustion portion is connected to an ash receiving chamber in which an ashpan is accessibly set and a oast is set in a combustion chamber, a tabular ceramics filter for removing harmful substances being attached to an upper portion of said oast, a suction portion consisting of a cover and a cyclone which inserts an end of an air duct of a blower to a lower end of an exhaust duct attached to said cyclone and has a dust receiver being attached to said incinerator having a suction port above said tabular ceramics filter.

5. An incinerator with a ceramics filter, wherein an intake pipe bent under a combustion portion is connected to an ash receiving chamber in which an ashpan in accessibly set and an oast is set in a combustion chamber, a tabular ceramics filter for removing harmful substances being attached to an upper portion of said oast, a first filter and a second filter, which contain a storage box, are supported by a spring, have a vibrator attached thereto and accommodate therein a spherical ceramics filter, being connected to said incinerator having a suction portion formed thereto above said tabular ceramics filters, said suction portion consisting of a cover and a cyclone which inserts an end of an air duct of a blower to a lower end of an exhaust duct attached to said cyclone and has a dust receiver being attached to said second filter.

6. An incinerator with ceramics filter, wherein an intake pipe bent under a combustion portion is connected to an ash receiving chamber in which an ashpan is accessibly set and an oast is set in a combustion chamber, a tabular ceramics filter for removing harmful substances being attached above said oast, a first filter in which said tabular ceramics filter is vertically set in an installation container being connected to said incinerator having a suction port formed thereto above said tabular ceramics filter, a second filter which has a storage box, is supported by a spring, has a vibrator attached thereto and accommodates a spherical ceramics filter being connected to said first filter, a third filter which has a storage box, is supported by a spring, has a vibrator attached thereto and accommodates a spherical ceramics filter being connected to said second filter, a suction portion consisting of a cover and a cyclone which inserts an end of an air duct of a blower to a lower end of an exhaust tube attached to said cyclone and has a dust receiver being connected to said third filter.

7. The incinerator with a ceramics filter according to claims 1, 2, 3, 4, 5 or 6, wherein burners are attached above and under said tabular ceramics filter.

8. The incinerator with a ceramics filter according to any one of claims 1, 2, 3, 4, 5 or 6, including a combustion chamber having a burner operative therein, and wherein said ceramics filter is pan-shaped.

9. The incinerator with a ceramics filter according to any one of claims 1, 2, 3, 4, 5 or 6, including a combustion chamber having a burner operative therein, and wherein said ceramics filter is cap-shaped.

10. The incinerator with a ceramics filter according to any one of claims 1, 2, 3, 4, 5 or 6, including a combustion chamber having a burner operative therein, and wherein said ceramics filter is a hollow spherical member.

11. The incinerator with a ceramics filter according to any one of claims 1, 2, 3, 4, 5 or 6, including a combustion chamber having a burner operative therein, and wherein said ceramics filter is a spherical member.

12. The incinerator with a ceramics filter according to claim 6, wherein a burner is attached to a vertically set tabular ceramics filter.

13. The incinerator with a ceramics filter according to claim 6, including a combustion chamber having a burner operative therein and wherein said ceramics filter is a vertically attached tabular ceramics filter having a heater embedded therein.

14. The incinerator with a ceramics filter according to claims 1, 2, 3, 4, 5 or 6, wherein a stove is attached under said tabular ceramics filter.

15. The incinerator with a ceramics filter according to claims 1, 2, 3, 4, 5 or 6, wherein a ceramics filter having a high-hat-like cross section is attached instead of said tabular ceramics filter and a burner is attached.

16. The incinerator with a ceramics filter according to any one of claims 1, 2, 3, 4, 5 or 6, including a combustion chamber having a burner operative therein, and wherein said ceramics filter is of U-shape in cross section.

17. The incinerator with a ceramics filter according to any one of claims 1, 2, 3, 4, 5 or 6, including a combustion chamber having a burner operative therein, and wherein said ceramics filter has a triangular cross section.

18. The incinerator with a ceramics filter according to any one of claims 1, 2, 3, 4, 5 or 6, including a combustion chamber having a burner operative therein, and wherein said ceramics filter has an inverted triangular cross section.

19. The incinerator with a ceramics filter according to any one of claims 1, 2, 3, 4, 5 or 6, including a combustion chamber having a burner operative therein, and wherein said ceramics filter is a continuous U-shaped ceramics filter.

20. A multistage incinerator with a ceramics filter, wherein a tabular ceramics filter is inclined and provided in each of a plurality of combustion chambers, a cabinet defining an oast being provided to one end of each said tabular ceramics filter, and including a burner being disposed under each said tabular ceramics filter.

21. The multistage incinerator with a ceramics filter according to claims 1, 2, 3, 4, 5 or 6, wherein said tabular ceramics filter is a catalytic filter.

22. The multistage incinerator with a ceramics filter according to any one of claims 1, 2, 3, 4, 5 or 6 wherein said tabular ceramics filter is a spherical filter which is a catalytic filter.

* * * * *